US006360809B1

(12) United States Patent
Cornie et al.

(10) Patent No.: US 6,360,809 B1
(45) Date of Patent: Mar. 26, 2002

(54) METHODS AND APPARATUS FOR HIGH THROUGHPUT PRESSURE INFILTRATION CASTING

(75) Inventors: James A. Cornie, Cambridge; Stephen S. Cornie, Watertown; Ralph P. Mason, Marlborough; Mark A. Ryals, Newton, all of MA (US)

(73) Assignee: Metal Matrix Cast Composites, Inc., Waltham, MA (US)

( * ) Notice: Subject to any disclaimer, the term of this patent is extended or adjusted under 35 U.S.C. 154(b) by 0 days.

(21) Appl. No.: 09/687,004

(22) Filed: Oct. 12, 2000

Related U.S. Application Data

(62) Division of application No. 09/015,822, filed on Jan. 29, 1998, now Pat. No. 6,148,899.

(51) Int. Cl.[7] ..... B22D 18/00; B22D 19/14; B22D 27/09

(52) U.S. Cl. ..... 164/65; 164/61; 164/97; 164/98; 164/120; 164/126

(58) Field of Search ..... 164/65, 61, 97, 164/98, 120, 126

(56) References Cited

U.S. PATENT DOCUMENTS

| | | | | |
|---|---|---|---|---|
| 576,482 A | 2/1897 | Streetman | ..... | 164/410 |
| 2,205,327 A | 6/1940 | Williams | ..... | 164/410 |

(List continued on next page.)

FOREIGN PATENT DOCUMENTS

| | | | | |
|---|---|---|---|---|
| DE | 3220744 | 6/1982 | | |
| DE | 3603310 | 2/1986 | | |
| DE | 4216870 | * 1/1993 | ..... | 164/126 |
| EP | 0340957 | 11/1989 | ..... | 164/100 |
| EP | 0 631 832 A1 | 1/1995 | | |
| GB | 2195277 | 4/1988 | | |
| GB | 2 301 545 A | 12/1996 | | |
| JP | 55-73443 | 6/1980 | | |
| JP | 58-50170 | 3/1983 | ..... | 164/61 |
| JP | 58-103953 | 6/1983 | ..... | 164/66.1 |
| JP | 58 157568 A | 9/1983 | | |
| JP | 60-70148 | 4/1985 | ..... | 164/120 |
| JP | 62-161461 | 7/1987 | ..... | 164/97 |
| JP | 62-286661 | 12/1987 | ..... | 164/61 |
| JP | 2-34271 | 2/1990 | ..... | 164/61 |
| SU | 1154343 | 5/1985 | ..... | 164/61 |

OTHER PUBLICATIONS

Russell et al., "Particulate Wetting and Particle: Solid Interface Phenomena in Casting Metal Matrix Composites," *Proceedings of the Symposium on Interfaces in Metal Matrix Composites*, New Orleans, Louisiana TMS–AIME, 1986, 61–91 (1986).

(List continued on next page.)

*Primary Examiner*—Nam Nguyen
*Assistant Examiner*—I.-H. Lin
(74) *Attorney, Agent, or Firm*—Testa, Hurwitz & Thibeault, LLP

(57) ABSTRACT

Disclosed are economical methods and apparatus for high throughput pressure infiltration casting. Methods of the invention use a mold vessel as an evacuation chamber along with an evacuation cap to produce superior quality near-net shape finished cast parts with low porosity. Other methods of the invention use an improved heat transfer technique for directionally solidifying molten infiltrant at an increased rate to increase further the throughput of the pressure infiltration casting cycle. The invention also provides apparatus for practicing methods for high throughput pressure infiltration casting. One embodiment of an apparatus of the invention is a removable evacuation cap, often used in conjunction with a fill tube. Another apparatus embodiment is an evacuation cap coupled to a mold vessel which is used as an evacuation chamber.

20 Claims, 11 Drawing Sheets

U.S. PATENT DOCUMENTS

| | | | | |
|---|---|---|---|---|
| 3,264,697 | A | 8/1966 | Price et al. | 164/65 X |
| 3,547,180 | A | 12/1970 | Cochran et al. | 164/61 |
| 3,554,268 | A | 1/1971 | Taylor et al. | 164/323 |
| 3,670,802 | A | 6/1972 | Krick et al. | 164/258 |
| 3,690,367 | A | 9/1972 | Daniels | 164/338.1 |
| 3,770,047 | A | 11/1973 | Kirkpatrick et al. | 164/338.1 |
| 3,913,657 | A | 10/1975 | Banker et al. | 164/62 |
| 4,492,265 | A | 1/1985 | Donomoto et al. | 164/493 |
| 4,508,158 | A | 4/1985 | Amateau et al. | 164/110 |
| 4,572,270 | A | 2/1986 | Funatani et al. | 164/97 |
| 4,573,517 | A | 3/1986 | Booth et al. | 164/61 |
| 4,658,881 | A | 4/1987 | Sasaki | 164/61 X |
| 4,832,105 | A | 5/1989 | Nagan et al. | 164/61 |
| 4,889,177 | A | 12/1989 | Charbonnier et al. | 164/97 |
| 5,042,561 | A | 8/1991 | Chandley | 164/63 |
| 5,097,887 | A | 3/1992 | Schmid et al. | 164/75 |
| 5,111,870 | A | 5/1992 | Cook | 164/61 |
| 5,111,871 | A | 5/1992 | Cook | 164/63 |
| 5,180,538 | A | 1/1993 | Vatant et al. | 266/91 |
| 5,275,227 | A | 1/1994 | Staub | 164/338.1 |
| 5,297,610 | A | 3/1994 | Noguchi et al. | 164/119 |
| 5,299,619 | A | 4/1994 | Chandley et al. | 164/61 X |
| 5,322,109 | A | 6/1994 | Cornie | 164/97 |
| 5,335,711 | A | 8/1994 | Paine | 164/66.1 |
| 5,524,700 | A | 6/1996 | Gosch | 164/136 |
| 5,553,658 | A | 9/1996 | Cornie | 164/97 |
| 5,620,041 | A | 4/1997 | Sato et al. | 164/63 |
| 5,787,960 | A | 8/1998 | Schmitt | 164/97 X |
| 5,908,065 | A | 6/1999 | Chadwick | 164/120 |
| 5,988,257 | A | * 11/1999 | Hugo | 164/126 |
| 6,003,587 | A | * 12/1999 | Mitsuhashi | 164/126 |

OTHER PUBLICATIONS

Se–Yong Oh, "Wetting of Ceramic Particulates with Liquid Aluminum Alloys," Ph.D. Thesis, Massachusetts Institute of Technology, 105–107 (1987).

Masur et al., "Pressure Casting of Fiber–Reinforced Metals," *ICCM–VI, Proceedings of the Sixth International Conference on Composite Materials*, London, 1987, 2.320–2.329 (1987).

Cornie et al., "Wetting, Fluidity and Solidification in Metal Matrix Composite Castings: A Research Summary," *ICCM–VI, Proceedings of the Sixth International Conference on Composite Materials*, London, 1987, 2.297–2.319 (1987).

Mortensen et al., "Kinetics of Fiber Preform Infiltration," *Proceedings of the International Symposium on Advances in Cast Reinforced Metal Composites*, Chicago, Illinois, 1988, 7–13 (1988).

Nourbakhsh et al., "An apparatus for pressure casting of fiber–reinforced high–temperature metal–matrix composites," *Journal Physics E. Scientific Instrument*, 21:898–902 (1988).

Mortensen, A., "Fundamental Aspects of Solidification Processing of Metal Matrix Composites by Pressure Infiltration Techniques," *Israel J. of Technology*, 24:359–367 (1988).

Mortensen et al., "Columnar Dendritic Solidification in a Metal–Matrix Composite," *Metallurgical Transactions A*, 19A: 709–721 (1988).

Oh et al., "Wetting of Ceramic Particulates with Liquid Aluminum Alloys: Part I. Experimental Techniques," *Metallurgical Transactions A*, 20A: 527–532 (1989).

Cornie et al., "Pressure Infiltration Processing of P–55 (Graphite) Fiber Reinforced Aluminum Alloys," *Ceramic Transactions, Advanced Composite Materials: Processing, Microstructures, Bulk and Interfacial Properties, Characterization Methods and Applications*, 19: 851–875 (1990).

Yang, Jingyu, "Casting particulate and fibrous metal–matrix composites by vacuum infiltration of a liquid metal under an inert gas pressure," *J. of Materials Science*, 24:3605–3612 (1989).

Klier et al., "Fabrication of cast particle–reinforced metals via pressure infiltration," *Journal of Materials Science*, 26: 2519–2526 (1991).

Nourbakhsh et al., "Processing of continuous–ceramic–fiber–reinforced intermetallic composites by pressure casting," *Materials Science and Engineering*, A144: 133–141 (1991).

Cook et al., "Pressure infiltration casting of metal matrix composites," *Materials Science and Engineering*, A144: 189–206 (1991).

Cornie et al., "Designing Interfaces in Inorganic Matrix Composites," *MRS Bulletin*, 16: 32–38 (1991).

Shanker, K. et al., "Properties of TaC–based metal–matrix composites produced by melt infiltration," *Composites*, 23(1): 47–53 (Jan. 1992).

Cornie et al., "Processing of Metal and Ceramic Matrix Composites," *Ceramic Bulletin*, 65(2):293–304 (1986).

Rohatagi, P., "Cast Aluminum–Matrix Composites for Automotive Applications," *J. of The Minerals, Metals & Materials Society*, pp. 10–15, Apr. 1991.

Bhagat, Ram B., "High pressure infiltration casting: manufacturing net shape composites with a unique interface," *Materials Science and Engineering*, A144:243–251 (1991).

Ottinger et al., "An Advanced Melt Infiltration Process for the Net Shape Production of Metal Matrix Composites," *A. Metallkd.* 84:827–831 (1993).

Cornie, J.A., "Advanced Pressure Infiltration Casting Technology For Metal Matrix Composite Components," *40th International SAMPE Symposium*, May 8–11, 1995.

Chambers et al., "The Strength And Toughness Of Cast Aluminum Composites As A Function Of Composition, Heat Treatment and Particulate," International Congress & Exposition, Detroit, Michigan, Feb. 26–29, 1996, paper 960162.

"MMC manufacturing—cheaper, faster," Advanced Materials News, p. 9, May 1995.

Cornie, James A., "Advanced Pressure Infiltration Casting Technology Produces Near–Absolute Net–Shape Metal Matrix Composite Components Cost Competitively," Materials Technology, vol. 10, No. 3/4, pp. 43–58, Mar./Apr. 1995.

B. Simon, ed., Metal Matrix Cast Composites, Inc. Newsletter, Spring 1998.

Metal Matrix Cast Composites To Exhibit At Tech 2007, News Release, Sep. 5, 1997.

* cited by examiner

METHODS AND APPARATUS FOR HIGH THROUGHPUT PRESSURE INFILTRATION CASTING

This is a division of application Ser. No. 09/015,822, filed Jan. 29, 1998 and now issued as U.S. Pat. No. 6,148,899, the entire disclosure of which is incorporated by reference herein.

This invention was made with government support under Grant No. N00167-95-C-0031. The government has certain rights in the invention.

FIELD OF THE INVENTION

This invention relates to methods and apparatus for pressure infiltration casting. More particularly, this invention relates to improved methods and apparatus for high throughput pressure infiltration casting.

BACKGROUND OF THE INVENTION

Various techniques for casting molten metals and metal-matrix composites have been developed. Gravity casting, permanent mold casting, die casting, investment mold casting and squeeze casting commonly are exploited. However, pressure infiltration casting offers advantages over these methods. Besides overcoming the non-wettability of molten metal with a reinforcement, i.e., a preform, and the ability to rapidly prototype components prior to large scale production, pressure infiltration casting can produce near-absolute net-shape cast parts with low to negligible porosity. As a result, pressure infiltration castings are used in automotive, truck, heavy construction equipment and outboard motor applications. Pressure infiltration castings also may be used in aerospace and sports applications.

Pressure infiltration casting generally is a process where a pressure differential is used to move molten infiltrant into a mold cavity to produce a conventional monolithic casting, i.e., an unreinforced casting, having the shape of the mold cavity. Pressure infiltration casting also includes moving a molten infiltrant into a mold cavity containing a preform. A preform typically is another metal or ceramic, usually of a particular shape and size such as a fiber. A reinforced casting, e.g., a metal-matrix composite, results from infiltration of a preform.

Pressure infiltration casting processes typically evacuate a mold cavity before addition of molten infiltrant to reduce or eliminate porosity of the finished product due to trapped air. Using the proper techniques, pressure infiltration casting can produce net shape reinforced composites or conventional castings with dimensional tolerances of ±0.0002 inches with a surface finish of 4 microinches (about 0.1 $\mu$m), i.e., a surface with a mirror-like finish.

The overall pressure infiltration casting process generally involves the steps of (1) heating a mold vessel containing a mold; (2) heating an infiltrant to a molten state; (3) evacuating the heated mold vessel; (4) adding the molten infiltrant to the evacuated heated mold vessel if not initially present in the mold vessel; (5) applying pressure to the molten infiltrant to move it into a mold cavity; and (6) solidifying the molten infiltrant to form a finished cast product. Certain of the above steps may be conducted simultaneously and in the same vessel. For example, the mold vessel and the infiltrant often are combined and heated in the same chamber of an apparatus, as are the steps of pressurizng and cooling often conducted in the same chamber, usually different from the heating chamber.

Heating the mold vessel, mold and infiltrant usually requires the greatest amount of time in the overall casting process. Infiltration of the mold cavity with the molten infiltrant typically is the fastest step, while solidification of the molten infiltrant in the mold takes longer than infiltration but less time than heating the mold vessel and infiltrant. Accordingly, the throughput of finished products, i.e., the number of parts cast per unit time, may be increased by shortening the length of time for an individual step in the overall process or by strategically segregating steps so certain tasks may be performed simultaneously.

Early pressure casting publications and patents generally disclose processes that use a one chamber apparatus to perform the whole casting process, i.e., heating, evacuating, adding infiltrant, pressurizing and cooling. See, e.g., U.S. Pat. No. 3,547,180 to Cochran, and U.S. Pat. No. 3,913,657 to Banker et al.; and DE 3603 310 A1 to Zapfe. State-of-the-art publications and patents generally disclose processes that use multi-chamber apparatus where typically the steps of heating and evacuating are separated from the steps of pressurizing and cooling. See, e.g., U.S. Pat. No. 4,832,105 to Nagan et al., and U.S. Pat. No. 5,335,711 to Paine; and DE 3220 744 A1 to Reuter et al. and GB 2,195,277 A to Doriath et al. However, state-of-the-art processes typically heat and evacuate a mold vessel and infiltrant in the same chamber.

In the aforementioned processes, the one chamber or multi-chamber apparatus is in use during the full casting cycle thereby occupying the entire apparatus for every step of the process. Since the entire apparatus is in use even during the slowest steps of heating and cooling, expensive vacuum and pressure equipment and chambers are used for only a short period of time. Thus, state-of-the-art pressure infiltration casting processes, even using multi-chamber apparatus, have a limited throughput because of the heating, and to a smaller degree cooling, steps.

It had been discovered that the steps of heating and evacuating may be conducted in a vessel separate from pressuring and cooling, however, these methods typically require the use of a vent tube. See, U.S. Pat. Nos. 5,322,109 and 5,553,658 to Cornie, which are herein incorporated by reference in their entirety.

Additionally, state-of-the-art pressure infiltration casting solidification methods generally involve using heat sinks, a chill zone or chill plate. See, e.g., U.S. Pat. No. 3,770,047 to Kirkpatrick et al.; U.S. Pat. Nos. 5,111,870 and 5,111,871 to Cook; and U.S. Pat. No. 5,275,227 to Staub. A chill plate often is made of metal in the shape of a pedestal which is brought into contact with a heated mold vessel after pressure has driven the molten infiltrant into the mold cavities. The chill plate also may have active means for facilitating the heat transfer process such as fluid flowing through the interior of the chill plate or through coiled pipes. Since cooling tends to be the second longest step in the pressure infiltration casting process, state-of-the-art solidification techniques also limit the overall throughput of the pressure infiltration casting process.

Accordingly, there exists a need for improved methods for pressure infiltration casting which economically produce with increased throughput high quality cast parts. In addition, there exists a need for improved apparatus for conducting high throughput pressure infiltration casting.

SUMMARY OF THE INVENTION

It is an object of this invention to provide an economical method for high throughput pressure infiltration casting which uses a mold vessel as an evacuation chamber to produce superior quality finished cast parts. It is another object of this invention to provide a method for high throughput pressure infiltration casting where the molten infiltrant is directionally solidified at an increased rate by using an improved heat extraction technique. It is a further object of this invention to provide apparatus for practicing methods for high throughput pressure infiltration casting. Apparatus include a removable evacuation cap in conjunction with a fill tube and a mold vessel/evacuation cap assembly which uses the mold vessel as an evacuation chamber.

The invention provides a pressure infiltration casting process which operates at the limits of processing time. High throughput is achieved in part by heating and evacuating a mold vessel containing a mold separate from heating the infiltrant. Accordingly, a dedicated source of molten infiltrant can be maintained while mold vessels are heated and staged while waiting to be evacuated and charged with molten infiltrant.

Subsequent to charging molten infiltrant to an evacuated mold vessel, the heated mold vessel containing molten infiltrant is transferred to a dedicated pressure vessel which typically contains means for cooling the molten infiltrant. Certain methods of the invention provide an improved solidification technique which increases the rate of directional cooling by using a low melting temperature material. Thus, the pressure infiltration casting methods of the invention strategically segregate the time restrictive tasks of the overall process to separate steps which simultaneously can be conducted. In particular, heating the mold vessel and infiltrant independent of the other steps avoids occupying vacuum and pressurizing equipment during the whole casting cycle.

Methods of the invention for pressure infiltration casting generally involve providing a mold vessel which houses a mold having a mold cavity. The mold cavity may contain a preform which will produce a reinforced casting. The mold cavity, optionally containing a preform, is evacuated using a vacuum source. A charge of molten infiltrant not in vacuum communication with the mold vessel then is added into the mold vessel while maintaining a reduced pressure, i.e., a vacuum, in the mold cavity.

An infiltrant separately is heated to form a molten infiltrant usually in a infiltrant heating vessel such as a crucible, also not in vacuum communication with the mold vessel. Subsequent to transporting the molten infiltrant into the mold vessel, pressure is applied to the molten infiltrant to move it into the mold cavity and preform, if present. Finally, the molten infiltrant is cooled in the mold cavity to produce a solidified finished cast product that can be recovered from the mold.

In certain embodiments of the invention, the method may involve the additional steps of heating a mold vessel to produce a heated mold vessel and insulating the heated mold vessel to produce an insulated heated mold vessel. Following addition of a charge of molten infiltrant into the mold vessel, the insulated heated mold vessel typically is transferred to a pressure vessel. In the pressure vessel, pressure is applied to drive the molten infiltrant into the mold cavities. If a low porosity finished product is desired, pressure may be applied continuously to the molten infiltrant during the cooling step to produce a high density, near net-shape cast part.

In other embodiments of the invention, the molten infiltrant is directionally solidified which may involve a low melting temperature material to increase heat transfer away from the molten infiltrant. The low melting temperature material has a liquid heat transfer zone which creates a liquid/solid interface with a heat transfer surface. The heat transfer surface, which is in thermal communication with molten infiltrant within a mold cavity, is exposed to the liquid heat transfer zone to solidify the molten infiltrant. The liquid heat transfer zone may be present prior to thermal communication with the mold vessel and mold or may form upon contact of a heated mold vessel with the low melting temperature material. Preferred low melting temperature materials include, but are not limited to, metals, metal alloys, salts and organic materials. Preferred metals or metal alloys are aluminum, antimony, bismuth, cadmium, gallium, indium, lead, tin, zinc, solder, woods metal and mixtures thereof.

In other embodiments of the invention, a high melting temperature material in thermal communication with the low melting temperature material may be used during the cooling step to more economically and/or efficiently facilitate heat transfer. Alternatively, an active cooler, e.g., piping having a cooling fluid pumped therethrough, may be used independently or with a low melting temperature material and/or high melting temperature material to further reduce the amount of low and/or high melting temperature material required.

The ratio of the amount of low melting temperature material and/or high melting temperature material to the amount of molten infiltrant should be at least equal to the ratio of the latent heat of fusion of the low melting temperature material and high melting temperature material to the latent heat of solidification of the molten infiltrant. Preferably, the ratio of the amount of low melting temperature material and/or high melting temperature material to the amount of molten infiltrant is at least 90%, and more preferably at least 75–80%.

In other embodiments of the invention, the step of transporting a charge of molten infiltrant into a mold vessel involves opening a vacuum seal. The vacuum seal may be a valve or other means for sealing a vacuum in the mold vessel. The same or a second vacuum seal also may control the flow of molten infiltrant.

In another aspect of the invention, apparatus for high throughput pressure infiltration casting are provided. One embodiment of an apparatus of the invention is a removable evacuation cap that permits a mold vessel to be evacuated and filled with molten infiltrant. By methods of the invention, the need for expensive vacuum chambers is eliminated since the mold vessel in essence becomes the vacuum vessel. Moreover, since the mold vessels and evacuation caps can be reused, production costs are reduced further.

The evacuation cap has a housing which has an interior surface and an exterior surface. The interior surface forms a seal with a mold vessel to allow reduced pressure to be realized in the interior space of the mold vessel. The evacuation cap also has at least one port extending through the housing which permits fluid communication through the housing. The port permits at least a vacuum source to communicate through the housing of the evacuation cap.

In another embodiment of the invention, the port of the evacuation cap also permits molten infiltrant to be charged to the interior space of the mold vessel. The apparatus typically has a vacuum seal in communication with the port to independently isolate a vacuum source and molten infiltrant from the interior of the mold vessel. The vacuum seal may be a vacuum sealing material, a valve or similar flow control device. A quick release or disconnect connection may be situated in a port to permit easy and efficient connection to a vacuum source or molten infiltrant source.

In another embodiment of the invention, the evacuation cap has at least a second port so the mold vessel is evacuated using one port and molten infiltrant is charged into the mold vessel through an independent second port. The apparatus may have a first vacuum seal in communication with the first port and a second vacuum seal in communication with the second port. The vacuum seals independently isolate the vacuum source and the molten infiltrant from the interior of the mold vessel. As above, the vacuum seals may be a vacuum sealing material, a valve or similar flow control device.

In yet other embodiments of the invention, the evacuation cap has a vacuum gasket contacting an interior surface of the evacuation cap. When the evacuation cap is sealed against the mold vessel, the vacuum gasket assists achieving and maintaining a vacuum in the mold vessel interior. The evacuation cap also may have an insulator on an interior surface of the evacuation cap. The insulator usually is in communication with the interior of the mold vessel when the evacuation cap is in use. The insulator helps prevent overheating of the evacuation cap and its components, e.g., analytical devices and gauges such as thermometers and/or manometers, electronic devices, gaskets, seals and the like. The evacuation cap also may have a cooler to assist in cooling the evacuation cap and its components to increase the functional lifetime of the evacuation cap.

In other preferred embodiments of the invention, the apparatus includes a fill tube or "snorkel" which has a first end in communication with a port of the evacuation cap. The fill tube has a second end which has a vacuum seal such as a vacuum sealing material, valve or similar flow control device. In preferred embodiments, the vacuum sealing material at the second end of the fill tube is meltable. In practice, the second end of the fill tube communicates with a source of molten infiltrant so molten infiltrant is charged into the mold vessel, sealing a vacuum in the mold cavities.

Another embodiment of an apparatus of the invention has an evacuation cap which may be sealed against a mold vessel. The evacuation cap and mold vessel independently may have one or more ports therethrough (although note that only one port is required in either location to practice the invention). In preferred embodiments, more than one port is present. The interior space of the mold vessel contains a mold which has a mold cavity. An evacuation cap sealed against a mold vessel isolates with the interior of the mold vessel, i.e., interior space, from its surrounding environment and permits efficient evacuation of the mold cavity. In a preferred embodiment of the apparatus, the evacuation cap is removable to allow the mold vessel to be independently transferred to a pressure vessel so the evacuation cap can be used with the next mold vessel/molten infiltrant assembly of the casting cycle production process. However, another embodiment of the apparatus has an evacuation cap permanently mounted on the mold vessel.

In embodiments containing a mold vessel, evacuation cap and one or more ports, the port(s) are positioned above the mold cavity and permit communication of the interior space of the mold vessel with the exterior of the mold vessel. The port(s) communicate through the evacuation cap and/or through a mold vessel wall. For example, the mold vessel may have the only port present for a particular embodiment of the invention or may have two or more ports. In addition, each of the evacuation cap and the mold vessel may have one or more ports. However, in a preferred embodiment of the invention, one or more ports are positioned through the evacuation cap.

It should be understood that the apparatus including the mold vessel/evacuation cap assembly may include any number or all of the previously described embodiments associated with the evacuation cap.

Reference to the figures are intended to provide a better understanding of the methods and apparatus of the invention but are not intended to limit the scope of the invention to the specifically drawn embodiments. Like reference characters in the respective drawn figures indicate corresponding parts. In addition, it should be understood that the individual steps of the methods of the invention may be performed in any order and/or simultaneously as long as the invention remains operable.

The invention will be understood further from the following drawings, description and claims.

DETAILED DESCRIPTION OF THE INVENTION

Figure 1A:
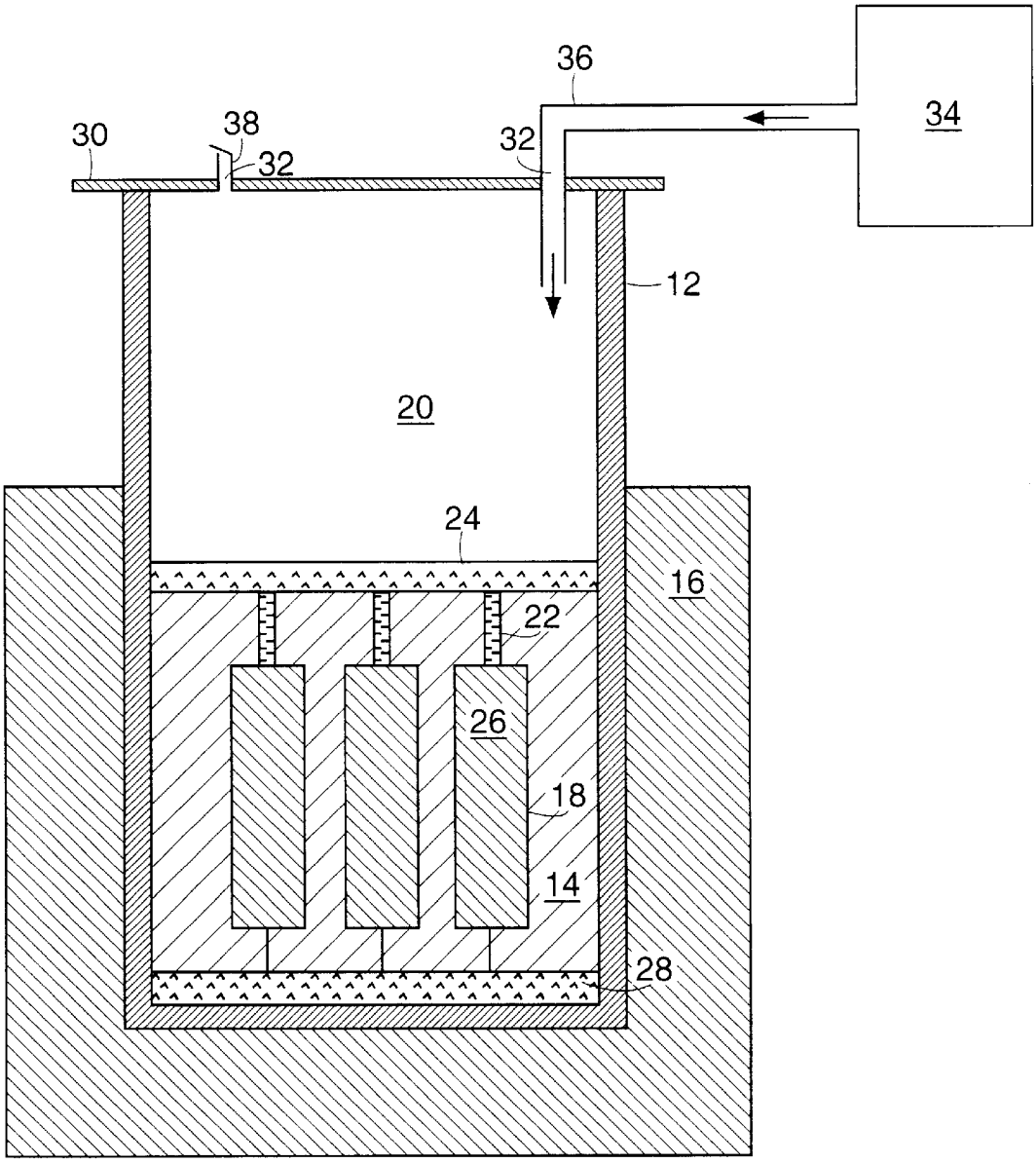
FIGS. 1A and 1B each are schematics of a side cross-sectional view of mold vessel assemblies of the invention under an inert atmosphere during the preheating stage.

The methods and apparatus of the invention permit practice of high throughput pressure infiltration casting easily and economically. The methods and apparatus of the invention simplify the overall casting process by allowing pre-evacuation heating to be done independently rather than tying up expensive evacuation and/or pressurization equipment, by increasing the reliability of the evacuation stage, by eliminating the need for disposable fixtures such as vent tubes, as well as by avoiding cumbersome equipment and methods. Methods of the invention further provide an improved heat extraction technique which directionally solidifies molten infiltrant at an increased rate by using a low melting temperature material. By using the improved heat transfer technique of the invention, the cooling stage of the casting process may be shortened, increasing the throughput of finished cast parts even further.

The methods of the invention generally involve separating the individual steps of the pressure infiltration process to isolate the steps consuming the greatest length of time. By melting an infiltrant in one vessel and preheating a mold in another vessel the time required to melt the infiltrant is independent of the time required to heat the mold vessel to the appropriate casting temperature. Since heating typically is the longest step in the overall process, the independent heating of the infiltrant and mold vessel does not occupy expensive machinery or apparatus at this preliminary stage. A dedicated source of molten infiltrant readily can be maintained while multiple mold vessels are heated and staged using standard heat transfer apparatus. Moreover, since methods of the invention use mold vessels as evacuation chambers, the need for a dedicated vacuum chamber either independently or as part of a larger apparatus is eliminated.

Subsequent to the heating stage, molten infiltrant is charged into a mold vessel after evacuation of the mold cavity. The charge of molten infiltrant typically is added from a source separated from and not in vacuum communication with the mold vessel. The charge of molten infiltrant seals the mold cavity from the interior of the mold vessel and maintains a reduced pressure in the mold cavity so the heated mold vessel containing the molten infiltrant can be independently transferred at atmospheric pressure to a pressure vessel or autoclave. Charging molten infiltrant into a mold vessel typically is a rapid and non-limiting step in respect to overall throughput. Thus, charging molten infiltrant rapidly can be accomplished, only limited by the number of heated mold vessels and amount of molten infiltrant available. Additionally, no expensive vacuum apparatus is required since the mold vessel acts as an evacuation chamber.

After placing the heated mold vessel containing molten infiltrant in a pressure vessel, pressure is applied to drive the molten infiltrant into the mold cavity. Pressurization is one of the least time consuming steps. Subsequent to infiltration, the molten infiltrant typically is directionally solidified, often with pressure being continually applied during the cooling process. By certain methods of the invention, a low melting temperature material increases heat transfer from the mold vessel solidifying the molten infiltrant faster, thereby further decreasing the amount of time the pressure vessel is in use. Thus, each step of the process generally is limited in time only with respect to its own requirements. Since infiltration and cooling of the molten infiltrant typically involves a relatively short time period, a pressure vessel will not be occupied for a long time in the overall cycle. Similar to the evacuation stage, one pressure vessel may produce many infiltrated mold cavities and/or finished cast parts in a given amount of time if a sufficient number of mold vessels and amount of infiltrant are preheated at the beginning of the production process.

An embodiment of a method of the invention includes the use of an assembly line-like set-up which involves mechanical moving means such as conveyor belts and mechanical arms to move a mold vessel and other equipment and components from preheating to cooling stages. This embodiment also may include computerization.

Preheating

Initially, a mold vessel containing a mold is preheated to above the solidification temperature of the infiltrant to be cast. Since the preheating may take a long time, many mold vessels can be heated simultaneously, e.g., on a foundry floor, and staged for evacuation and addition of molten infiltrant. Concurrent with preheating the mold vessels, an infiltrant is heated in a separate vessel to a temperature above its melting point. Often the infiltrant is superheated to well above its melting point so the infiltrant remains molten until cooling is intentionally initiated. A large quantity of infiltrant may be heated to provide the necessary reservoir of molten infiltrant for addition to a number of evacuated mold vessels. Since heating takes the greatest time, preheating a large number of mold vessels and a corresponding amount of infiltrant permits one vacuum source and one pressure vessel to achieve a high throughput since the later stages of the casting process are relatively fast and non-limiting.

An infiltrant may be any composition of matter which is solid at ambient temperature and is capable of being transformed into a liquid, typically homogenous in nature. An infiltrant commonly refers to a metal or metal alloy. However, an infiltrant also may be molten salts, molten glass or various resins. Examples of common metals and metal alloys, among others, are aluminum, aluminum alloys, bronze, beryllium, beryllium alloys, chromium, chromium alloys, cobalt, cobalt alloys, copper, copper alloys, gold, iron, iron alloys, magnesium, magnesium alloys, nickel, nickel alloys, lead, lead alloys, copper, tin, and zinc, as well as superalloys.

Figure 1B:
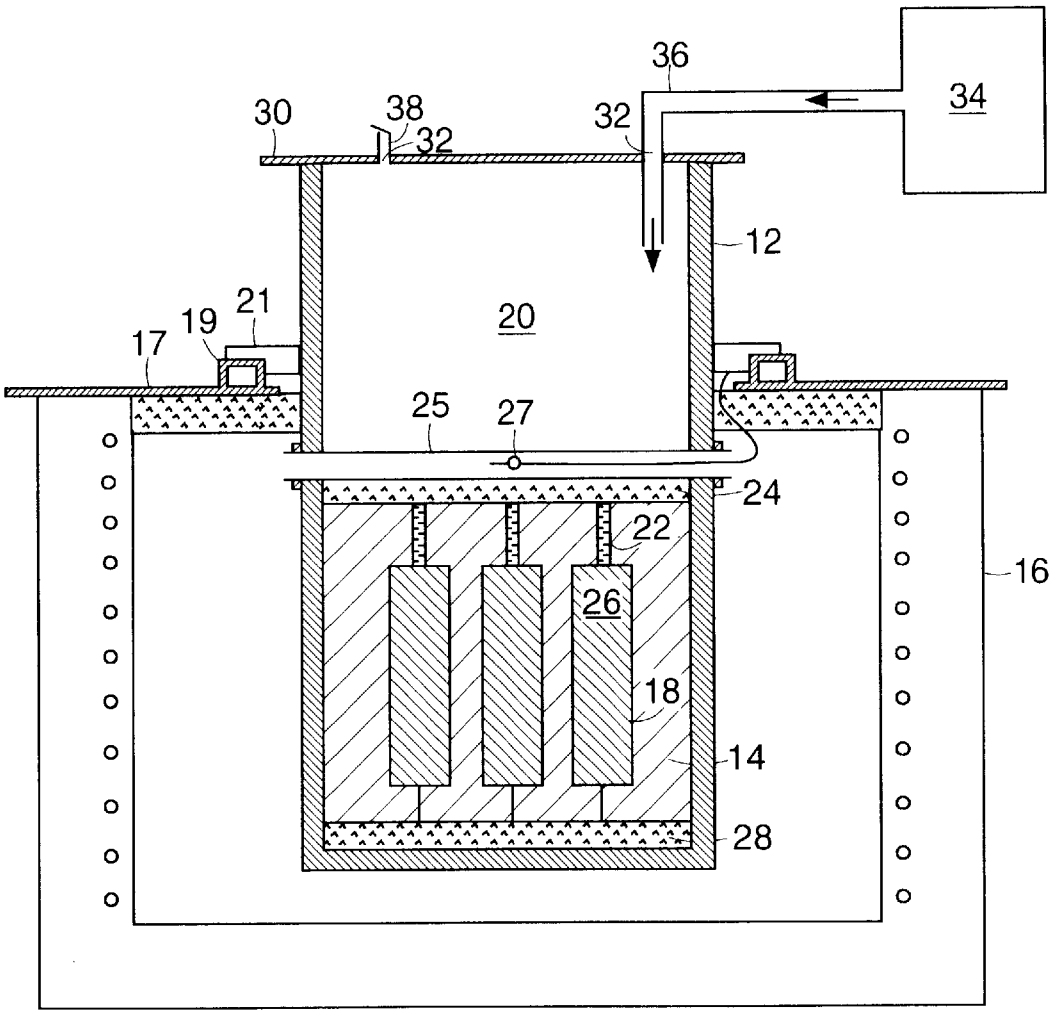

FIGS. 1A and 1B each depict a mold vessel assembly under an inert atmosphere during the preheating stage. Mold vessel 12 containing a mold 14 generally is positioned in a preheat furnace 16. As shown in FIG. 1A, the preheat furnace 16 may be in intimate contact with the mold vessel 12. In a preferred embodiment shown in FIG. 1B, the mold vessel 12 is suspended in the preheat furnace 16 by using a suspension plate 17.

The suspension plate 17 typically rests on top of the preheat furnace 16 and has an aperture or hole in its center of an appropriate size to accommodate the mold vessel's cross-sectional area. The suspension plate 17 often has one or more braces 19. A holding rod 21 extending from the mold vessel 16 may rest on and/or be secured by the brace 19 to prevent the mold vessel from directly resting against the suspension plate 17 and from significantly moving during the preheating stage.

The preheat furnace 16 may preheat the mold vessel 12 prior to evacuation and may maintain the mold vessel 12 at a specific temperature or range of temperatures during the evacuation and addition of molten infiltrant stages. The mold vessel 12 usually is made of steel or another appropriate relatively inert material having the proper physical properties for pressure infiltration casting vessels as recognized by one skilled in the art.

The mold 14 may be formed from two or more pieces tightly fitted together in the mold vessel 12 and may contain one or more mold cavities 18. The mold 14 usually fits snugly in the mold vessel 12 so the mold cavities 18 are well defined and isolated except for their gates 22. Each mold cavity 18 will have a configuration of the part to be cast. Molds 14 may be made of a variety of different materials depending on factors such as the infiltrant, pressure infiltration casting process parameters and the product control specifications of the cast part.

Many different pressure infiltration casting mold materials are known in the art and may be used in the practice of the invention. See, e.g., U.S. Ser. No. 08/588,909, filed Jan. 19, 1996 by Cornie; Zhang, G. D. et al., "Control of Interface Reactions Between P-55 Fibers and Aluminum Alloy Matrices During Pressure Infiltration Processing," Third International Conference on Composite Interfaces (ICCI-III), Controlled Interphase Structures, H. Ishida, ed., pp. 343–357 (Elsevier Science, May, 1990); Li, Q. et al., "Microstructure of the Interface and Inter-fiber Regions in P-55 Reinforced Aluminum Alloys," Third International Conference on Composite Interfaces (ICCI-III), Controlled Interphase Structures, H. Ishida, ed., pp. 131–145 (Elsevier Science, May, 1990); and Cornie, J. A. et al., "Pressure Infiltration Processing of P-55 (Graphite) Fiber Reinforced Aluminum Alloys," in *Ceramic Transactions, Advanced Composite Materials*, M. D. Sacks, ed., 19:851–875 (The American Ceramic Society, Inc., Westerville, Ohio, 1991), which are herein incorporated by reference in their entirety.

Other structural features shown in FIGS. 1A and 1B are common of a typical mold vessel assembly for pressure infiltration casting. The mold cavity 18 typically communicates with the interior of the mold vessel 20 via a gate 22. (Note that the interior of the mold vessel 20 also is referred to herein as "interior space" or "interior space 20.") The gate 22 is contained in the mold 14 and is a source of molten infiltrant for a mold cavity 18 during the infiltration and solidification stages. A mold vessel 12 may contain only one mold 14 having one or more mold cavities 18, or may contain multiple molds, each having one or more mold cavities. When multiple mold cavities 18 are present in a mold, the configuration of the gates 22 may vary as recognized by a skilled artisan. That is, multiple independent gates 22 may communicate the mold cavities 18 with the mold vessel interior 20 as shown in FIGS. 1A and 1B. A gate 22 also may have one channel leading from the interior of the mold vessel 20 with multiple channels branching therefrom providing communication to each of the mold cavities 18.

Subsequent to fitting the mold(s) 14 into the mold vessel 12, a filter 24 often is placed over the gate(s) 22. The filter 24 typically is made of alumina fiber compact or alumina silicate fibers such as the filter material sold under the trade names Fiberfrax™ manufactured by Carborundum and Kaowool™ manufactured by Thermal Ceramics, Inc. The filter 24 prevents molten infiltrant from entering a gate 22 and mold cavity 18 prior to intentional infiltration.

As shown in FIG. 1B, a restraining device 25 may be used to prevent the mold 14 from shifting during transfer of the mold vessel 12 or from floating after molten infiltrant is charged to the mold vessel interior 20. The restraining device 25 may be a bar or tube which passes through the interior of the mold vessel 20 and is level with the top of the mold 14 as shown in FIG. 1B. The restraining device also may be a piece of metal welded to the interior of the mold vessel or simply a weld spot on the interior of the mold vessel above the mold. The restraining device typically is made of a suitable rigid material such as steel. If a restraining device 25 which passes through the mold vessel 12 is used, typically it is welded to the exterior of the mold vessel wall to ensure the interior of the mold vessel 20 is isolated from its surrounding environment. If a tube is used as shown in FIG. 1B, a thermocouple 27 may be inserted into the tube to monitor the temperature at the top of the mold during the preheating and solidification processes. Typically the thermocouple communicates with a temperature recorder or other device to record and manipulate the input data into its desired form.

The mold cavity 16 optionally may contain a preform 26. Preforms 26 typically are metals or ceramics such as oxides, borides, nitrides, carbides and carbon. Most preforms may be used in the invention as would be recognized by one skilled in the art. See, e.g., U.S. Pat. No. 5,511,603 to Brown et al.; and U.S. Pat. Nos. 5,322,109 and 5,553,658 to Cornie; and Oh, S-Y. et al., *Metallurgical Transactions A,* 20A:527–532 (1989); Oh-S-Y. et al., *Metallurgical Transactions A,* 20A:533–541 (1989); Mortensen, A. et al., *Metallurgical Transactions A,* 20A:2535–2547 (1989); Mortensen, A. et al. *Metallurgical Transactions A,* 20A:2535–2557 (1989); Cornie, J. A. et al., "Pressure Infiltration Processing of P-55 (Graphite) Fiber Reinforced Aluminum Alloys," in *Ceramic Transactions, Advanced Composite Materials*, M. D. Sacks, ed., 19:851–875 (The American Ceramic Society, Inc., Westerville, Ohio, 1991); and Cook, et al., *Materials Science and Engineering*, A144:189–206 (1991), which are herein incorporated by reference in their entirety.

During the practice of a method of the invention, a mold vessel usually is prepared by coating the interior of the mold vessel with an appropriate mold wash for the particular metal or metal alloy to be cast. The mold wash is applied to prevent interaction between the mold vessel and the molten infiltrant. For aluminum alloy and magnesium alloy castings, the mold wash preferably is one or more layers of colloidal carbon, e.g., colloidal graphite, which is dispersed in a suitable volatile vehicle. However, other ceramic slurry coatings may be used. For bronze and copper castings, contamination of the bronze or copper by the mold vessel may be prevented by using an appropriate mold washing. An example of a mold washing is a slurry is of a binder, zirconium oxide, in a slightly acidic vehicle which is sold under the trade name Zircwash™. Other parting compounds may be used as mold washes such as boron nitride or graphite foil. In addition to coating the mold vessel, the mold cavity 18 often is coated with the appropriate mold wash to serve as a parting plane and facilitate the removal of the cast part from the mold.

Prior to placing the mold vessel 12 into or in contact with the preheat furnace 16, an insulation layer 28 often is placed on the bottom of the mold vessel 12. The insulation layer 28 provides thermal insulation for the mold vessel 12 preventing premature cooling of the molten infiltrant in the mold cavity 18 during transfer of the mold vessel 12. The insulation layer 28 may be any suitable insulation material such as a ceramic fibrous felt sold under the trade names Fiberfrax™ or Duraboard™.

Typically the mold vessel 12 and mold 14 are assembled, e.g., as shown in FIGS. 1A and 1B, then are pre-heated before being attached to a vacuum source. A preheating stage allows many mold vessels 12 to be heated individually or collectively and staged before the evacuation step. As previously mentioned, since heating the mold vessel 12 usually consumes the largest amount of time, preheating can be done with simple heat transfer equipment or furnaces in a separate area of the foundry floor. This technique does not require evacuation and/or pressurization equipment to be occupied during this stage of the process. Depending on the equipment available, various strategies for exploiting methods of the invention may be realized including automation of temperature control of the furnace or other heating equipment and/or positioning and movement of mold vessels and relevant equipment.

Since the mold vessel 12 and molds 14 may be preheated and staged over a period of time, the molds 14 may be protected from oxidation by covering with an inert gas to which forms a protective layer. As shown in FIGS. 1A and 1B, a temporary cover 30 may be placed on the mold vessel 12 to isolate the interior of the mold vessel 20 from its surrounding environment. The temporary cover 30 may be secured or unsecured to the mold vessel 12. The temporary cover 30 may have one or more ports 32 serving as inlets and/or outlets for gases and/or liquids. An inert gas such as nitrogen, argon or helium supplied from an inert gas source 34 may be pumped into the interior of the mold vessel 20 through an inert gas inlet 36.

If the temporary cover 30 is able to be separated from the mold vessel 12 with little force, only one port 32 may be necessary to purge the interior of the mold vessel 20 with an inert gas. When sufficient pressure is attained in the mold vessel interior 20, gases may escape via the non-secured contact between the temporary cover 30 and the mold vessel 12 or through a release valve 38 possibly positioned within another port 32. Use of a release valve 38 is preferred as it will more efficiently and controllably purge the mold vessel interior.

Figure 2:
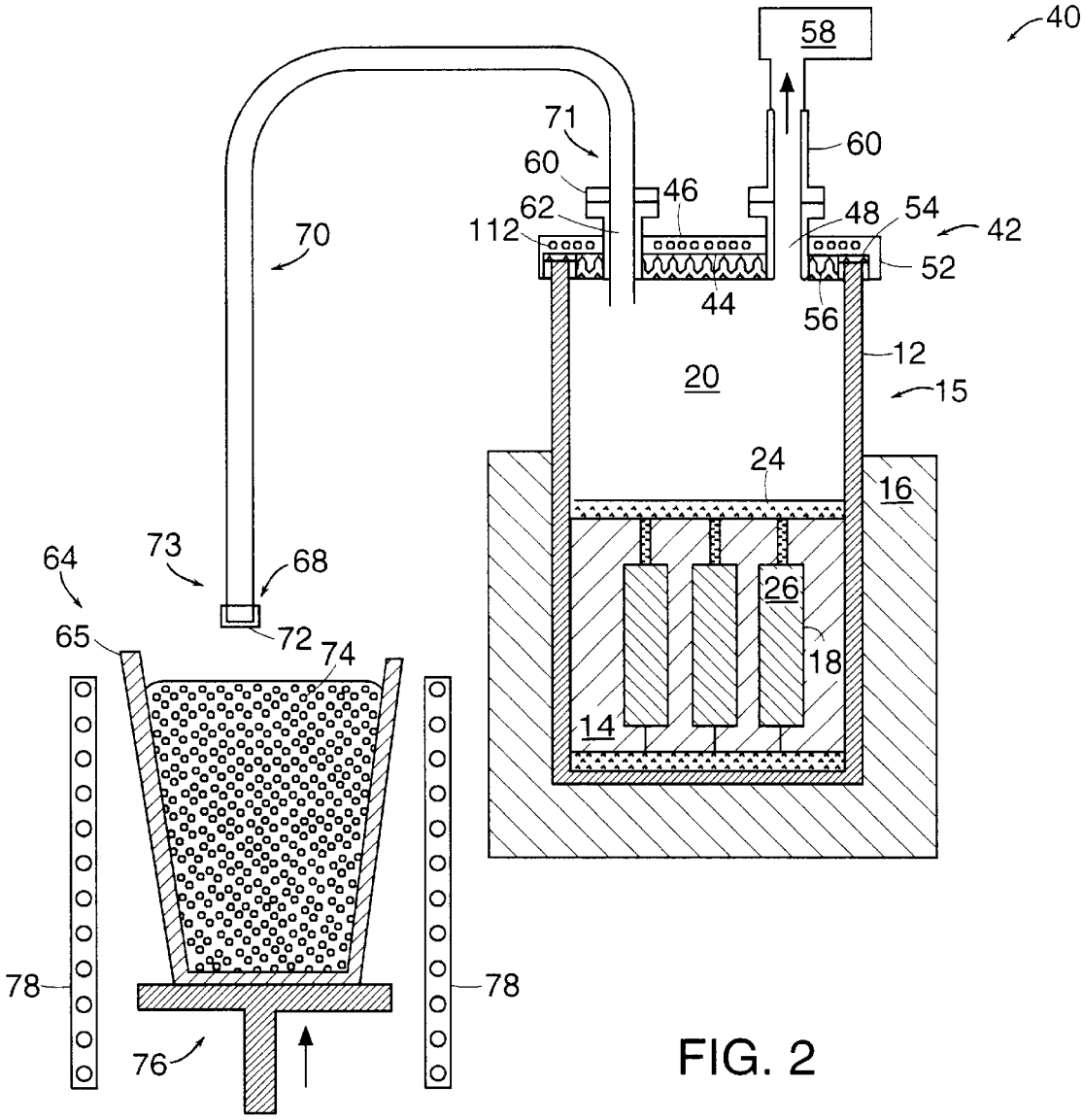
FIG. 2 is a schematic of a side cross-sectional view of a preferred evacuation cap with fill tube and mold vessel assembly of the invention during the evacuation stage where the mold vessel is used as a evacuation chamber. A source of molten infiltrant independent of the vacuum source also is shown.

Concurrent with heating a mold vessel and before the evacuation stage of the process, an infiltrant typically is heated in a separate infiltrant heating vessel until completely molten and usually homogenous in nature. As shown in FIG. 2, a source of molten infiltrant 64 usually is a large crucible 65 or other appropriate high temperature-stable container to hold the molten infiltrant. An infiltrant heating vessel, e.g., a crucible 65, may be heated by conventional heat transfer equipment 78 or other means known to skilled artisans. Melting of an infiltrant and maintaining molten infiltrant may be controlled manually or with the assistance of automation and/or computerization.

Evacuation Stage

To produce high quality cast parts with low porosity, it is necessary to evacuate the mold cavities prior to infiltration of the molten infiltrant. Removal of excess gas in the mold cavities not only reduces the porosity of the finished product but also assists in the filling of the mold cavities since the pressure differential required to drive the molten infiltrant into the mold cavity and preform, if present, is reduced. In addition, the excess gas may become entrapped and compressed within the cast part. Upon heating the cast part, e.g., heat treatment, the compressed gas voids expand to form blisters and/or other large void defects at the surface of or within the cast part.

After the mold vessels are preheated and a source of molten infiltrant is available, the next step typically is evacuation of the mold vessel interior including mold cavities. The mold vessel interior is evacuated usually with a vacuum source, such as a simple vacuum pump. Given the appropriate process parameters and temporary cover 30, the evacuation step may be accomplished simply by replacing the source of inert gas with a vacuum source. However, in a preferred embodiment of the invention shown in FIG. 2, the temporary cover 30 is removed and replaced with a fitted removable evacuation cap 40 which seals the interior space 20 from its surrounding environment. Preferably, the seal is air-tight so that the mold vessel interior 20 and the mold cavities 18 can be evacuated to a pressure well below atmospheric pressure. An evacuation cap 40 of the invention encompasses any device or material which is capable of isolating the interior space 20 regardless of whether the evacuation cap 40 has any apertures.

While separate heat sources or furnaces may be used in the preheating and evacuation steps, a preheating furnace 16 may serve the dual function of heating the mold vessel and mold to above the solidification temperature of the molten infiltrant and maintaining the mold vessel and mold at an elevated temperature during the evacuation steps. Using the preheating furnace 16 for both steps avoids transferring the mold vessel 12, saving time and preventing possible heat loss.

For high temperature casting such as copper and bronze, the fitted removable evacuation cap 40 may be welded to the mold vessel 12. Welding the evacuation cap 40 to the mold vessel 12 permits a sufficient seal to isolate the mold vessel interior 20 from the surrounding atmosphere and avoids the use of heat sensitive elastomeric gaskets and seals. A mold vessel 12 having a welded evacuation cap 40 permits the whole mold vessel/evacuation cap assembly to be positioned completely in the preheat furnace 16 during the evacuation and filling stages.

Typically situated above the furnace are quick disconnect fittings 60 in ports of the evacuation cap which communicate a vacuum source 58 and a source of molten infiltrant 64 with the interior of the mold vessel 20. Depending on the parameters of the casting cycle, an evacuation cap 40 that is welded to a mold vessel 12 may have one or more of the features as shown in FIG. 2 described below.

It should be understood that an evacuation cap which has no apertures or ports may be used in methods of the invention. That is, the required port for communicating the interior space of the mold vessel with a vacuum source and/or a source of molten infiltrant may be present on the mold vessel, i.e., communication occurs through the walls of the mold vessel. In these embodiments, as with an evacuation cap with ports, the ports should be above the top of the mold cavity which is housed in the mold vessel.

Referring to FIG. 2, a preferred evacuation cap 40 of the invention has a housing 42 which has interior surface 44 and an exterior surface 46. The evacuation cap 40 also has at least one port 48 that permits fluid communication through the housing 42. Typically, the port 48 is perpendicular to the plane of the exterior surface of the evacuation cap 46. The interior surface of the housing 44 usually is shaped to fit the top cross-sectional dimensions of the walls of the mold vessel 15. The interior surface 44 may have a channel for accepting the top of the walls of a mold vessel 15. The interior surface 44 may have a raised area that coincides with the top cross-sectional dimensions of the mold vessel interior 20. Other designs for the interior surface 44 which assist in forming a sufficient seal between the evacuation cap 40 and mold vessel 12 would be recognized by one skilled in the art.

The evacuation cap 44 also may have a lip 52 extending outward from the interior surface of the evacuation cap 44, usually perpendicular to the plane of the interior surface 44. The lip 52 may be at the periphery of the interior surface of the evacuation cap 44 or extend from some other point on the interior surface 44. The lip 52 is particularly beneficial when its inner surface is contiguous with the outer surface of the mold vessel walls 15. With many of these arrangements, the evacuation cap 40 fits over the mold vessel 12 with a relatively tight fit so the cap does not shift easily.

An evacuation cap 40 may have a vacuum gasket 54 to assist the formation of an air-tight seal with a mold vessel 12. The vacuum gasket 54 may be located at the periphery of the interior surface of the evacuation cap 44 or on the interior surface 44 adjacent to a raised lip 52 or other surface. The vacuum gasket 54 also may be positioned in a channel in the interior surface of the evacuation cap 44 as previously described. The vacuum gasket 54 typically is an elastomeric material such as neoprene, halogenated neoprene, Viton rubber or n-Buna, but any material known to those skilled in the art which provides a vacuum sealed environment may be used. The particular shape and dimensions of the vacuum gasket 54 are dependent on many factors, e.g., the materials of construction, the weight and size of the evacuation cap 40, the position of the gasket, the magnitude of the vacuum pressure to be attained and the shape of the mold vessel 12.

Preferably, the evacuation cap 40 also has means for preventing overheating of the evacuation cap 40 and its components. Means for preventing overheating often include an insulator 56 present on the interior surface of the evacuation cap 44. The insulator 56 may be a refractory radiation shield or other means to reflect or dissipate heat away from the evacuation cap 40. Insulator materials often are constructed of material similar to the filter 24 such as alumina fiber compact or alumina silicate fibers. Insulators 56 include, among others, Fiberfrax™ blankets, Duraboards™ and firebrick. The placement and thickness of the insulator 56 is dependent on the pressure infiltration casting processing temperatures and heat sensitivity of the evacuation cap components. Insulation also may be placed in areas outside the interior of the mold vessel 20 if necessary to further protect the evacuation cap 40 and its components.

The insulator 56 on the interior surface of the evacuation cap 44 assists in reducing overheating of the evacuation cap 40, vacuum gasket 54 and other heat sensitive components of the evacuation cap such as electronics and instrumentation, e.g., a thermometer, manometer or other device for measuring or recording a particular physical property. Since pressure infiltration casting process temperatures may cause decomposition of gasket materials and other susceptible components of the evacuation cap 40, a preferred evacuation cap 40 has active cooling to increase the lifetime of the cap and its components. In addition, as described earlier for a preferred embodiment for high temperature castings, the evacuation cap 40 may be welded to the mold vessel 12 to isolate the mold vessel interior 20, avoiding the use of temperature sensitive gaskets, seals, and the like.

Active cooling means includes, but is not limited to, flowing a cooling liquid through the evacuation cap 40 or through tubes or pipes in intimate contact with the evacuation cap 40. As shown in FIG. 2, the active cooling means is tubing 112 having a cooling liquid flowing therethrough. In more sophisticated evacuation caps, active cooling means may include cooling technology applied to refrigerators and the like which may be adjacent to or part of the evacuation cap. These embodiments may be particularly beneficial if extremely heat sensitive components or devices are used.

Referring further to FIG. 2, either before or after the evacuation cap 40 is placed on the mold vessel 12, a vacuum source 58 is connected to a port 48 of the evacuation cap 40. When assembled, the vacuum source 58 communicates with the interior of the mold vessel 20. A tube or other connector from the vacuum source 58 may be positioned in the port 48 directly or with the use of a quick release/disconnect mechanical seal arrangement 60 for ease in connection and removal at later stages of the infiltration casting process. Other means of efficiently connecting a vacuum source 58 to a port 48 are well known in the art.

An evacuation cap 40 may have additional ports for a variety of functions. In a preferred embodiment shown in FIG. 2, a second port 62 permits molten infiltrant 74 to enter the mold vessel interior 20. As with all ports of the evacuation cap 40, devices such as connectors, fittings, valves and the like may be positioned in or adjacent the ports. A release valve for control of the internal pressure usually is present in conjunction with the vacuum source. However, an additional release valve may be located on the evacuation cap 40 or the mold vessel 12 for additional control or monitoring.

Figure 3A:
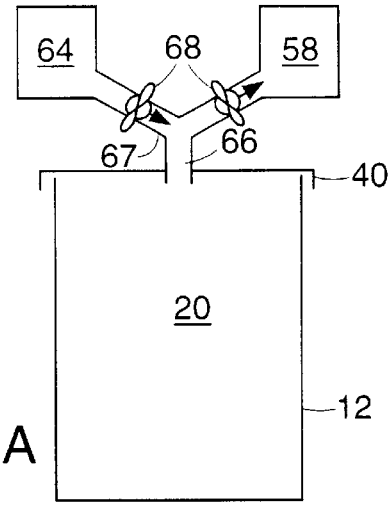
FIGS. 3A–C are schematics of side cross-sectional views of examples of alternate arrangements of the source of molten infiltrant, vacuum source, and an evacuation cap/mold vessel assembly of the invention where the evacuation cap has one port.
Figure 3B:
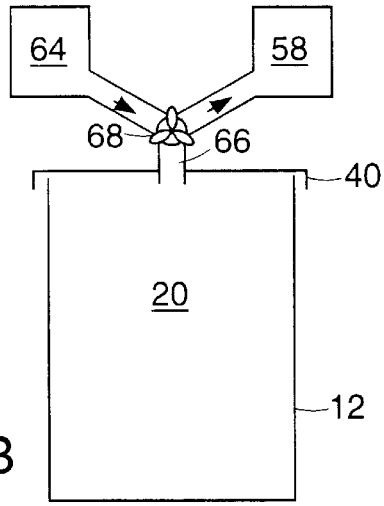
Figure 3C:
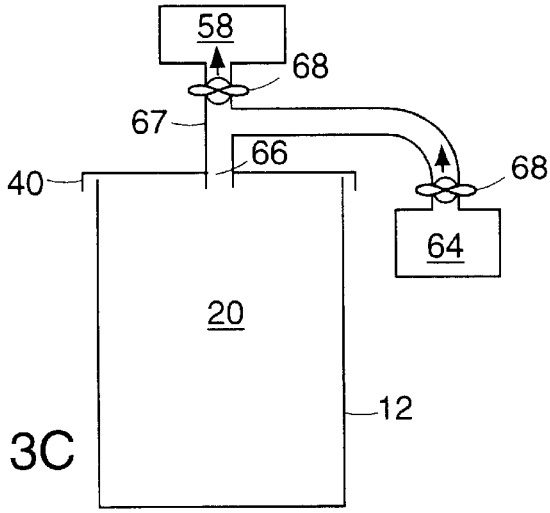

Although FIG. 2 depicts an evacuation cap 40 with two ports, a vacuum port 48 and a molten infiltrant port 62, it should be understood that many different arrangements and connections may be utilized to achieve the same purpose. FIGS. 3A–C depict examples of alternate arrangements which may isolate a vacuum source 58 from the source of molten infiltrant 64. As depicted, the vacuum source 58 and the source of molten infiltrant 64 have a common port 66 to the interior of the mold vessel 20 although the two sources are isolated from each other.

More specifically, FIG. 3A shows an evacuation cap 40 having a common port 66 and a connector 67 in a "Y" configuration extending therefrom. The connector 67 and independent vacuum seals 68 independently provide communication between the mold vessel interior 20 and the vacuum source 58 and molten infiltrant source 64.

FIG. 3B is similar in design, however, the vacuum seal 68 is a three-way valve which permits the mold vessel interior 20 to communicate with either the vacuum source 58 or the source of molten infiltrant 64. In this embodiment, the vacuum source will be interrupted prior to charging the molten infiltrant into the mold vessel 12.

In FIG. 3C, another arrangement using a common port 66 is shown. Here, as in FIG. 3A, independent vacuum seals 68 independently control evacuation of the mold vessel interior 20 and addition of molten infiltrant from a molten infiltrant source 64. It should be appreciated that the placement of the vacuum source 58 and the molten infiltrant source 64 could be reversed so that gravity assists the addition of molten infiltrant into the mold vessel 12 in addition to the vacuum in the mold vessel interior 20 and atmospheric pressure on the molten infiltrant.

An evacuation cap 40 may have additional means for sealing. That is, although the weight of the evacuation cap 40 and the vacuum pressure should be sufficient to secure the cap to the mold vessel 12, other attachment devices may be desired to maintain contact between the evacuation cap 40 and mold vessel 12. Examples of attachment devices include, among others, cotters such as cotter pins, buckles, clasps, clamps, latches, screws, locks and the like.

Subsequent to sealing the interior of the mold vessel 20, an appropriate vacuum pressure is established in the interior of the mold vessel 20 and mold cavities 18 by actuating the vacuum source 58 to evacuate the interior of the mold vessel 20. Depending on the assembly used, communication may be accomplished by turning the vacuum source 58 on and/or by opening a vacuum seal 68 such as a valve. The reduced pressure required for a particular casting process will depend on many factors, however, a preferred vacuum pressure is on the order of about less than 10 mm of mercury with a more preferred vacuum pressure being on the order of less than about 1 mm of mercury.

Addition of Molten Infiltrant To Mold Vessel Stage

Figure 4A:
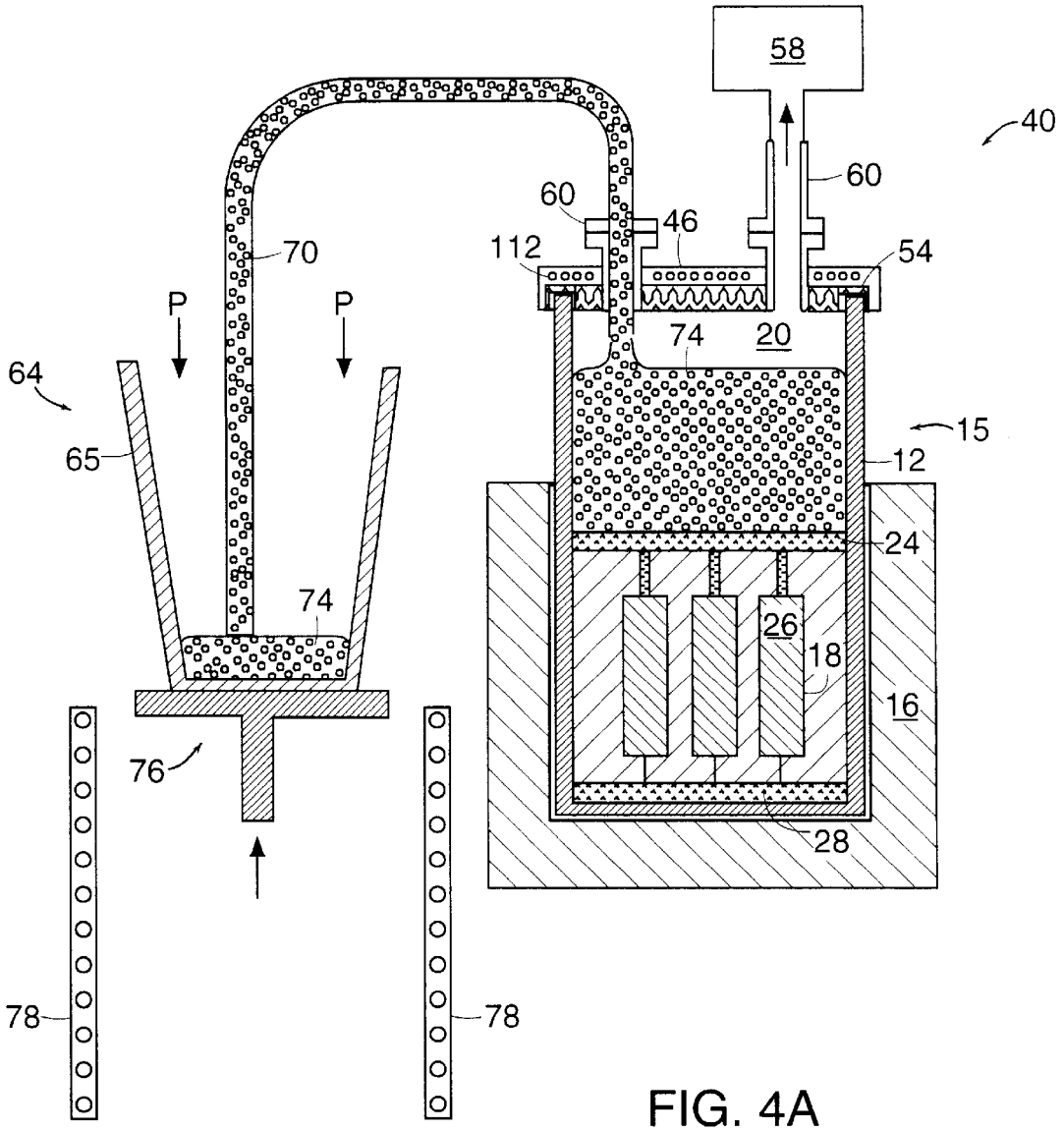
FIGS. 4A and 4B are a schematics of side cross-sectional views of preferred evacuation caps with a fill tube and mold vessel assembly of the invention during charging of molten infiltrant into the interior of the mold vessel while maintaining a vacuum in the mold cavity of the mold.

Molten infiltrant may be charged to the mold vessel interior using a number of devices and techniques. Piping and spigot connections can supply the molten infiltrant with the help of gravity, atmospheric pressure and/or the vacuum pressure present in the mold vessel interior. Other techniques may involve the use of pumps, pistons and more sophisticated equipment. In a preferred embodiment of the invention, as shown in FIGS. 2 and 4, molten infiltrant 74 is provided to the interior of the mold vessel 20 through a fill tube 70. The fill tube 70 can be any kind of tube, pipe or other means for communicating molten infiltrant 74 with the interior of the mold vessel 20.

Preferably the fill tube material is flexible to allow various configurations to be realized as well as for ease of use during the casting process. The fill tube 70 should be made of a material that is inert with respect to the molten infiltrant 74. A thin wall low carbon steel tubing is preferred. A non-limiting example is automobile exhaust system tubing which is extremely inexpensive and may be reused.

The fill tube 70 also may be double-walled to permit easy removal from the evacuation cap 40 and to isolate the charge of molten infiltrant from the heat sink that results from the use of quick disconnect fittings 60 and the length of the fill tube 70 that the molten infiltrant must travel (i.e., molten infiltrant prematurely may solidify in the fill tube). In certain embodiments, the outer tube of a double-walled fill tube may be split and welded to the evacuation cap 40 and coupled by the quick disconnect fitting 60 which serves as a vacuum seal. The inner tube of the double-walled fill tube may be relatively continuous which permits the inner tube to extend through the evacuation cap 40 into the interior of the mold vessel 20.

As with the interior of the mold vessel and mold cavity, a mold wash as previously described typically is applied to the interior surfaces of the fill tube to help prevent contamination of the molten infiltrant with the material of the fill tube during the charging of the molten infiltrant into the interior of the mold vessel.

One end 71 of the fill tube 70 may be extended into the interior of the mold vessel 20 through a second port 62 in the evacuation cap 40. However, referring again to FIG. 2, the fill tube 70 may be completely or partially inserted into a second port 62 or into an extension of a port such as a quick release mechanical seal 60 which itself extends into the mold vessel interior 20. Connecting the fill tube 70 with a quick disconnect seal arrangement 60 or some similar device allows the fill tube 70 readily to be secured and removed during the pressure infiltration casting process.

The other end 73 of the fill tube 70 typically has a vacuum seal 68 near its terminus which isolates the interior of the mold vessel 20, mold cavities 18 and fill tube 70 so a reduced pressure can be maintained in the mold cavities 18. The vacuum seal 68 may be a valve, vacuum seal material, a rupture diaphragm or other means for maintaining the integrity of a vacuum such as shrink fitting or casting a slug in place. These devices and materials readily are recognized by one skilled in the art.

In a preferred embodiment of the invention, the vacuum seal 68 on a second end of the fill tube 73 is a meltable vacuum seal 72. The meltable vacuum seal 72 may be attached to the fill tube by a variety of means including clamps, elastic rings such as o-rings and elastics or any other method which achieves an appropriately tight seal for maintaining a vacuum pressure in the mold vessel interior 20.

The meltable vacuum seal preferably is a thin sheet of material having the same composition as the molten infiltrant. In these preferred embodiments, the molten infiltrant contacts and melts the meltable vacuum seal commingling the vacuum seal material with the molten infiltrant. Since the same material of construction is used for the meltable vacuum seal, no contamination of the infiltrant occurs. However, in practice, the amount of meltable vacuum material required to seal the fill tube should be small in comparison to the total amount of molten infiltrant to be cast not to influence greatly the overall composition of the molten infiltrant and, thus, the finished cast product. Therefore, a great variety of meltable vacuum sealing materials may be used including, but not limited to, metals, metal alloys, plastics and other gas impermeable membrane materials.

After the appropriate vacuum pressure is achieved in the mold cavities, molten infiltrant is charged to the interior of the mold vessel by opening a vacuum seal in communication with the molten infiltrant. The vacuum source may maintain communication with the interior of the mold vessel if the molten infiltrant will not damage or contaminate the vacuum source. Alternatively, the vacuum source may be interrupted by using a vacuum seal to break the communication between the vacuum source and the interior of the mold vessel or by turning off the vacuum source. Since the time needed to charge the molten infiltrant into the interior of the mold vessel after disengaging the vacuum source is small, no significant loss of vacuum pressure in the interior of the mold vessel and mold cavities should occur if good vacuum seals have been achieved. Moreover, the vacuum remaining in the interior of the mold vessel should be sufficient for atmospheric pressure outside the mold vessel interior to drive the molten infiltrant into the mold vessel without an external source of pressure.

Referring to FIG. 2, a reduced pressure in the interior of the mold vessel 20 is achieved using a vacuum source 58 in communication with the interior of the mold vessel 20 via a port 48 with a quick release connection 60. A meltable vacuum seal 72 at a second end of a fill tube 73 completes isolation of a closed system, i.e., isolation of the interior of the mold vessel 20 from its surrounding environment. Subsequent to achieving an appropriate reduced pressure, the second end of the fill tube 73 having a meltable vacuum seal 72 is contacted with molten infiltrant 74.

As shown in FIGS. 2 and 4, the source of molten infiltrant 64 may be raised by a lifting device or mechanism 76 such as a pedestal or platform attached to lifting means such as a jack so the second end of the fill tube 73 enters the molten infiltrant 74. The source of molten infiltrant 64 may have independent heating means 78 such as a furnace or may have a dedicated intimate source of energy to melt an infiltrant and maintain its molten state prior to addition into a mold vessel 12. Other means of contacting the meltable vacuum seal 72 of the fill tube 70 with molten infiltrant 74 readily are known to those skilled in the art and may include some form of automation and/or computerization.

The molten infiltrant 74 typically is superheated so the meltable vacuum seal 72 readily melts and the molten infiltrant 74 is charged through the fill tube 70 into the interior of the mold vessel 20. As shown in FIG. 4, the force of atmospheric pressure acting in the direction of the arrows from the reference letters "P" on the exposed surface of the molten infiltrant 74 usually results in efficient addition of molten infiltrant 74 to the mold vessel interior 20. It should be understood that the amount of molten infiltrant 74 charged into the interior of the mold vessel 20 needs to be sufficient for the mold vessel 12 and mold cavities 18 used in a particular casting cycle. That is, the amount of molten infiltrant 74 should fill the gates 22 and mold cavities 18 completely while also providing a sufficient reservoir to compensate for shrinkage during solidification. The amount of molten infiltrant 74 also should be sufficient initially to cover the top cross-sectional area of the mold vessel interior 20 to ensure the gates 22 are covered and a vacuum in the mold cavities 18 is isolated. Additionally, any voids present around the mold 14 or in the insulation layer 28 should be included in the amount of molten infiltrant 74 required.

Since the vacuum in the interior of the mold vessel 20 should not be interrupted until a sufficient quantity of molten infiltrant 74 has entered the mold vessel 12 and covered the gates 22 leading to the mold cavities 18, the molten infiltrant 74 forms a hermetic seal at the interface of the interior of the mold vessel 20 and the opening of the gates 22 adjacent to the mold vessel interior. As a result, a vacuum is isolated below the molten infiltrant 74 within the gates 22 and mold cavities 18. A filter 24 may be positioned at the opening of the gates 22 to help prevent molten infiltrant 74 from prematurely entering the mold cavities 18. The mold vessel 12 containing the molten infiltrant 74 now is ready for transfer to a pressure vessel or autoclave for infiltration of the molten infiltrant 74 into the mold cavities 18, optionally containing a preform 26.

Prior to transfer of the mold vessel 12 containing molten infiltrant 74, the evacuation cap 40 and associated connections typically are removed so the evacuation cap 40 can be used with the next preheated mold vessel. Certain methods and apparatus of the invention permit the vacuum source 58 and fill tube 70 to be disconnected from their respective ports and the mold vessel/evacuation cap assembly transferred to a pressure vessel. In these embodiments, the evacuation cap 40 usually is permanently mounted to the mold vessel 12 via a movable connection such as a hinge. The mold vessel 12 also usually is removed from the heating furnace 16 prior to transfer to the pressure vessel.

Figure 5:
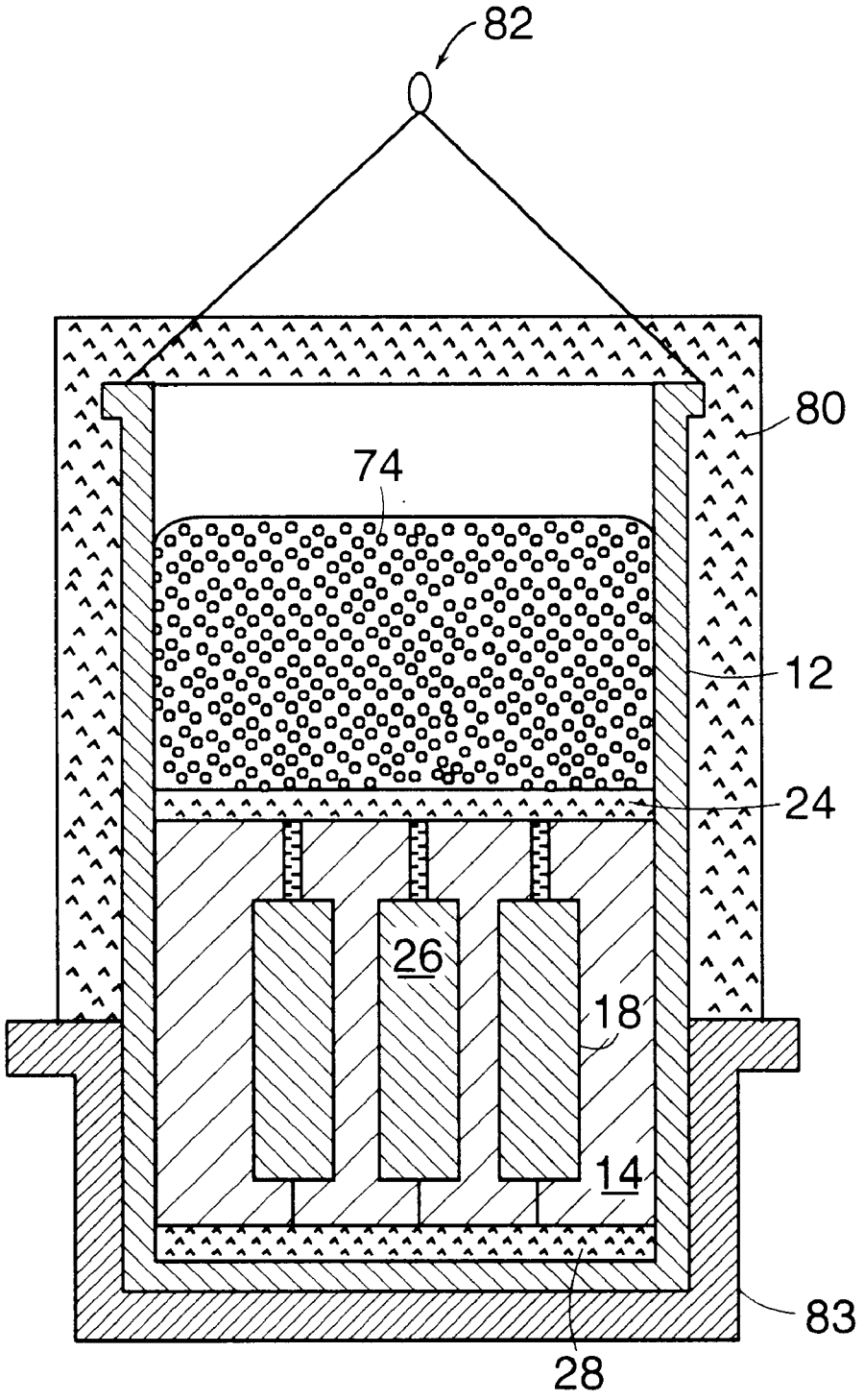
FIG. 5 is a schematic of a side cross-sectional view of an insulated mold vessel assembly containing molten infiltrant during transfer to a pressure vessel.

In addition, before transferring the mold vessel to a pressure vessel, often the mold vessel will be insulated to prevent the molten infiltrant from prematurely solidifying. One technique is to use an insulating jacket 80 which may be placed over a mold vessel 12 as shown in FIG. 5. The insulating jacket 80 may be made of any insulating material known by those skilled in the art including, but not limited to, the same materials as used for the insulator 56 on the evacuation cap 40. The insulating jacket 80 may be fitted for a particular mold vessel design or simply wrapped or placed on or around the mold vessel 12. As shown in a preferred embodiment in FIG. 5, the insulating jacket 80 is fitted to help retard heat loss from the upper portion of the mold vessel 12.

The bottom insulation layer 28 in the mold vessel 12 helps retard heat loss through the bottom of the mold vessel 12. For infiltrants with high melting points, e.g., copper and copper alloys, it often is desirable to insulate the bottom of the mold vessel 12 even further before transfer to a pressure vessel by using an insulating sock 83 as shown in FIG. 5. Accordingly, the combination of insulators helps ensure a substantial portion of the mold vessel 12 and its contents are kept at a sufficient temperature to prevent premature solidification. However, the insulating sock 83 usually is removed prior to placing the heated mold vessel assembly into an autoclave or pressure vessel to facilitate directional solidification towards the source of molten infiltrant in the mold vessel interior.

Although the insulating jacket 80 also may be removed prior to placement in a pressure vessel, the insulating jacket 80 usually remains on the mold vessel 12 during the steps of pressurizing and cooling to assist directional solidification of the molten infiltrant 74. By insulating the top and side walls of a mold vessel 12, a "hot top" or reserve of molten infiltrant is maintained in the mold vessel interior 20 which is in communication with solidifying infiltrant at the solidification front. As discussed in more detail in the next section, continually applying pressure to the hot top during cooling allows quality high density near net-shaped cast parts with minimal porosity to be produced.

Transfer of the mold vessel containing the molten infiltrant may be accomplished by a variety of methods depending on many factors such as the size and weight of the mold vessel assembly and the available equipment. The mold vessel containing molten infiltrant manually may be moved to a pressure vessel using insulated gloves or other appropriate tools such as tongs. In a preferred embodiment shown in FIG. 5, a suspension rig 82 is attached to the mold vessel 12 for facilitating transfer as well as for suspending the mold vessel 12 in a pressure vessel. A suspension rig 82 may be any device or component useful for transferring or suspending an object. Examples of suspension rigs include, but are not limited to, chains, belts, hooks, wires and cables. The mold vessel 12 containing molten infiltrant 74 also may be moved to a pressure vessel by mechanical means which may involve automation and/or computerization.

For high temperature castings where the evacuation cap 40 may be welded to the mold vessel 12, a suspension rig 82 may be one or more lift cables 81 directly or indirectly attached to the evacuation cap 40. That is, a suspension rig 82 may be employed earlier in and/or throughout the casting process, e.g., during the steps of preheating, evacuating and charging the molten infiltrant into the mold vessel interior, as well as during pressurization and solidification. The suspension rig 82 permits the mold vessel/evacuation cap assembly to be positioned in the preheat furnace so most of the assembly within the furnace, maintaining the assembly at an appropriate temperature above the solidification point of the molten infiltrant.

Figure 4B:
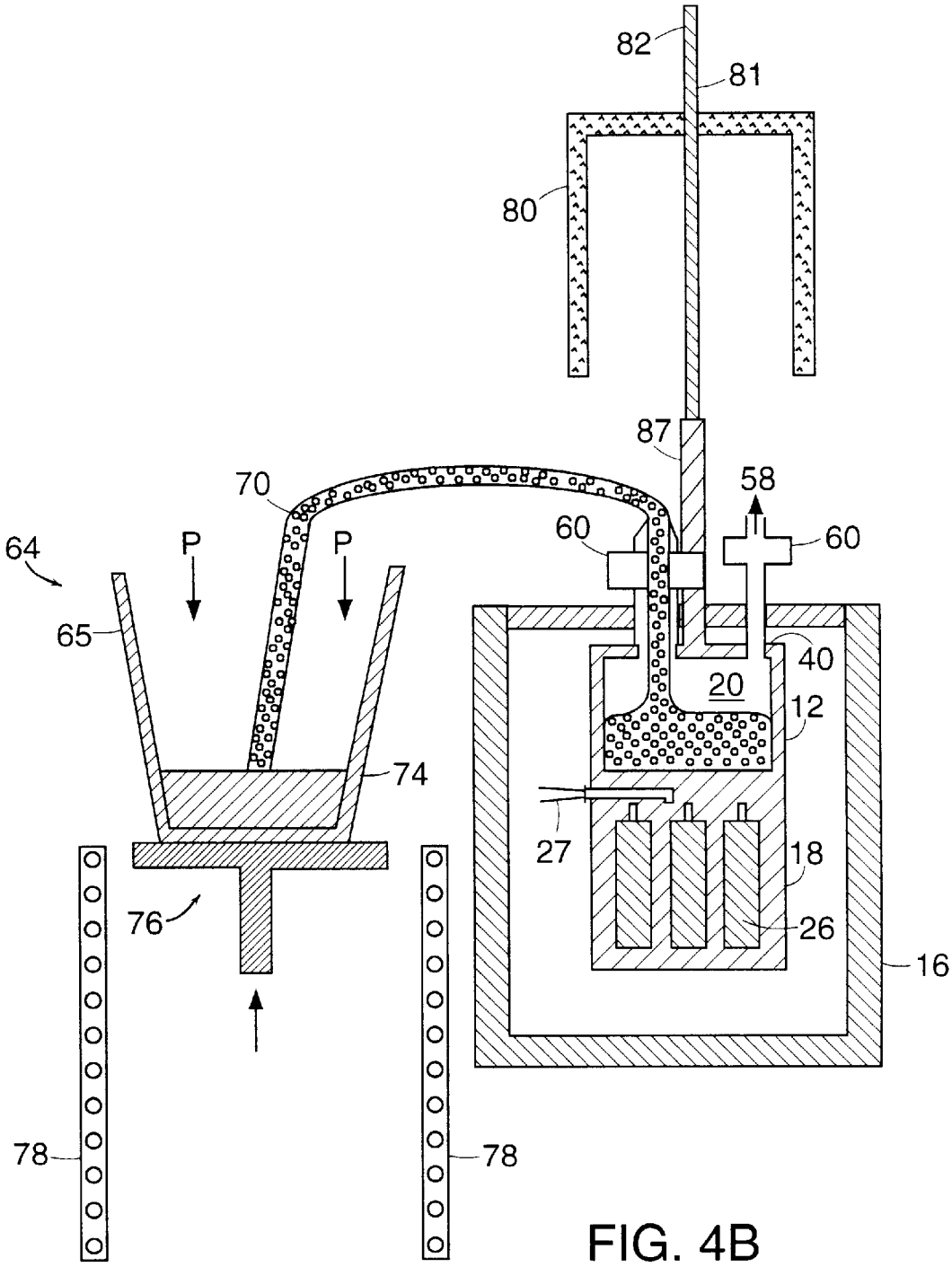

As shown in FIG. 4B, a single lift cable 81 is used as a suspension rig 82. The lift cable 81 is attached to the center of the evacuation cap 40 using a mold vessel lifting attachment 87. Accordingly, an insulating jacket 80 may be positioned around the lift cable 81 so that the insulating jacket 80 may be slid onto the mold vessel 12 subsequent to charging the molten infiltrant 74 into the mold vessel interior 20 and removing the fill tube 70 and vacuum source 58. Removal of the fill tube and vacuum connections may involve cutting of the tubing above the level of the evacuation cap 40 and/or quick disconnect fittings 60. Then the insulated mold vessel/molten infiltrant assembly can be transferred to a pressure vessel. This technique helps prevent heat loss throughout the first stages of the casting cycle as well as increasing the automation potential of the overall process since less manipulation of the equipment is necessary.

Pressurization Stage

Subsequent to charging a molten infiltrant into an evacuated mold vessel containing one or more mold cavities, the mold vessel/molten infiltrant assembly is transferred to a pressure vessel for infiltration of the molten infiltrant into the mold cavities. Typically, pressure is applied to drive a molten infiltrant past a filter into a mold cavity, optionally containing a preform. After infiltration is complete, the mold vessel is cooled usually in the direction opposite infiltration. Pressure often is applied during the cooling steps so a pressure vessel usually is the site for solidification of the molten infiltrant. After complete or partial solidification, the mold vessel may be removed from the pressure vessel and the finished cast part recovered from the mold cavity.

Practically, the mold vessel needs to remain at a temperature at or above the melting point or liquidus temperature of the infiltrant during the pressurization step. Preferably the mold vessel is heated to a temperature at least about 25° C., and more preferably 50° C., above the liquidus temperature of the infiltrant. However, the proper mold vessel temperature for any process depends on many factors including deleterious reactions of the molten infiltrant and/or mold vessel materials of construction which may occur at higher temperatures. For casting aluminum-containing parts, typically the mold vessel is heated to a temperature at least 25° C. above the liquidus temperature of the aluminum or aluminum alloy. For copper castings which have a higher melting point, the mold vessel often is heated to a temperature at least 50° C. above the liquidus temperature of the copper or copper alloy.

In addition, the molten infiltrant should be superheated. Preferably the molten infiltrant is heated to a temperature greater than 50° C., and more preferably greater than 75° C. or 100° C., above its liquidus temperature. Maintaining these temperatures prevents premature solidification of the molten infiltrant prior to complete infiltration especially since heat loss continuously occurs from the molten infiltrant during the casting process. Generally compared to infiltrants with lower melting points, high melting point infiltrants are heated to higher temperatures above their liquidus points since maintaining a higher temperature is more difficult during the casting process. For example, aluminum and its alloys typically are heated to about 50° C. above their liquidus temperature, while copper and its alloys are heated to above about 100° C. above their liquidus temperature. Accordingly, if pressurization and solidification occur in the same vessel, the molten infiltrant needs to experience an initial pressure to move it into the heated mold cavity and preform, if present, before cooling is initiated. It is critical that the mold cavities and preforms are completely infiltrated prior to a rapid decrease in temperature.

Separation of pressurization and solidification may be accomplished by suspending a mold vessel in a pressure vessel for the initial pressurization then contacting the mold vessel with a chill, i.e., a means of cooling. A chill generally is any composition of matter, i.e., solid, liquid and/or gas and combinations thereof, which is capable of cooling molten infiltrant. Cooling using a chill generally involves contacting the chill with the mold vessel. Contact can be accomplished by raising or lowering either the chill or mold vessel, or some combination thereof. Contact also can be made by flowing a chill across a portion of a mold vessel among other techniques.

Figure 6:
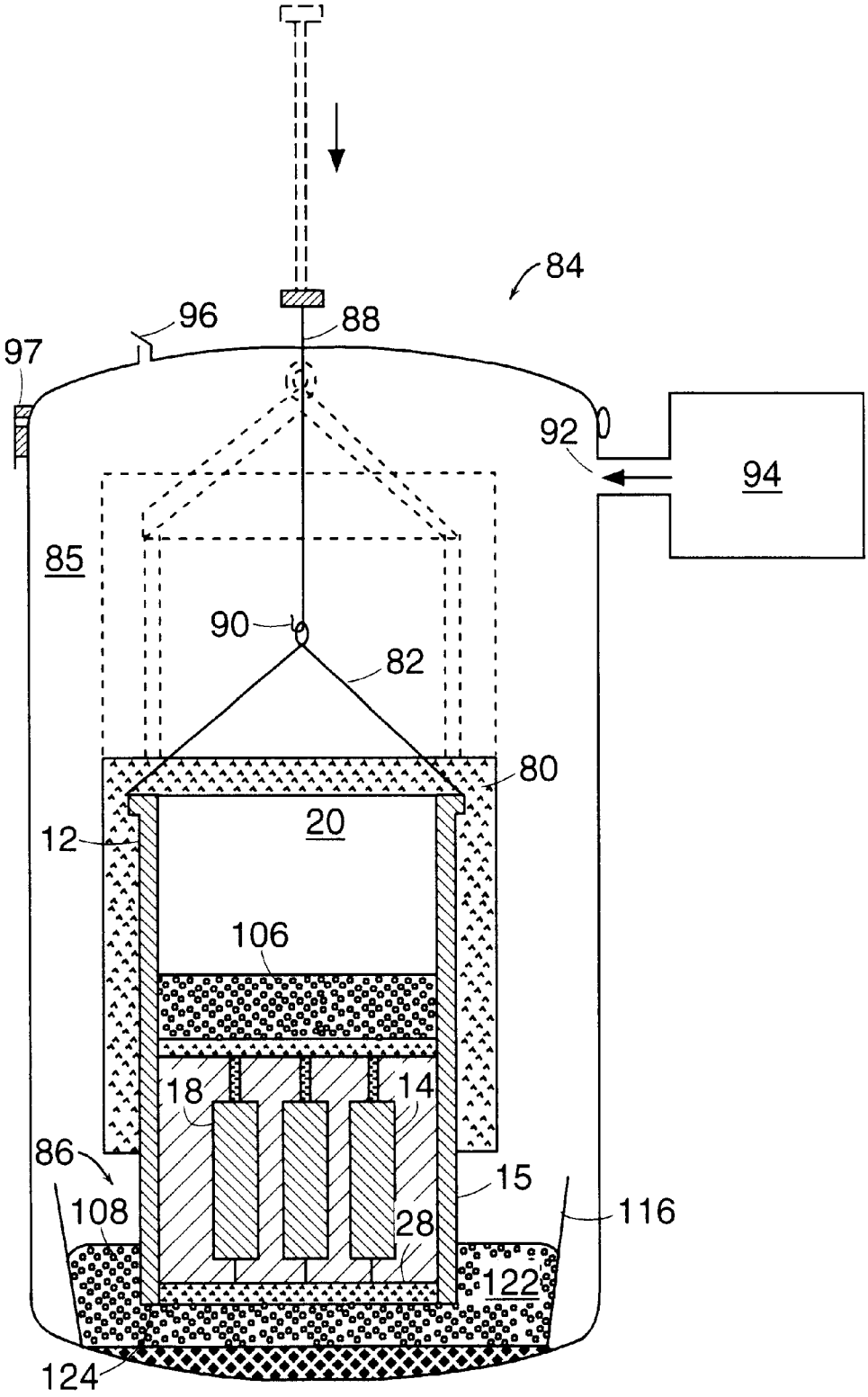
FIG. 6 is a schematic of a side cross-sectional view of an example of an insulated mold vessel in a pressure chamber during solidification using a low melting temperature material.

FIG. 6 illustrates a preferred embodiment of a pressure vessel 84 after infiltration where a mold vessel 12 suspended by a suspension rig 82 has been lowered into a chill 86 using an actuator 88. Besides a suspension rig 82, other means of contacting a chill 86 with a mold vessel 12 subsequent to pressurization may be employed. For example, in a more preferred embodiment, a linear actuator, or product arm, is connected through the top of the pressure vessel 84 so that the actuator 88 can be raised and lowered within the interior of the pressure vessel.

Attachment means is present on the actuator, typically at the end located in the interior of the pressure vessel 85 to permit the mold vessel 12 to be connected to the product arm. Attachment means include, but are not limited to, hooks, holes, various connectors and couplers and the like. Complementary attachment means also are present on the mold vessel 12 to allow the actuator 88 to be linked either directly or indirectly to the mold vessel. That is, the mold vessel 12 may have a hook, a hole or holes, a coupler, a strap, a chain or a cable that is capable of linking to the attachment means on the actuator 88. In a preferred embodiment, the mold vessel 12 has a chain as its suspension rig 82 which is hung on a hook 90 of the actuator 88.

Pressure vessels useful in practice of the invention should be of sufficient dimensions to accept and separate at least one mold vessel assembly and a chill. Since pressurization and solidification often are conducted in the same pressure vessel, typically only one mold vessel is suspended in a pressure vessel per cycle. However, depending on the size of the mold vessel and the interior of the pressure vessel, multiple mold vessels may be simultaneously pressurized and solidified.

Referring to FIG. 6, the pressure vessel 84 typically has an inlet port 92 in communication with a source of compressed gas 94. The pressure vessel 84 also typically has a release valve 96 or vent both as a practical means to control the pressure and as a safety device.

A preferred procedure for pressurization and solidification involves hanging a suspension rig 82 attached to a mold vessel 12 on a hook of an actuator 90. The actuator 88 is moved to the raised position, if not already there, and the pressure vessel 84 is sealed usually by closing a sealing device such as a latch 97 which securely isolates the interior of the pressure vessel 85. The pressure vessel interior 85 is pressurized to the appropriate infiltration pressure and after a sufficient amount of time has elapsed for complete infiltration, the actuator 88 is lowered so the bottom of the mold vessel 12 contacts the chill 86. When the molten infiltrant 74 has solidified, the actuator 88 is raised to lift and separate the mold vessel 12 from the chill 86. Subsequently, the pressure vessel 84 is vented, opened and the mold vessel 12 removed.

The amount of pressure required to drive molten infiltrant into a mold cavity, optionally containing a preform, is dependent on the critical threshold pressure for the particular molten infiltrant, mold cavity and preform, if present.

See, Oh, S-Y. et al., *Metallurgical Transactions A,* 20A:527–532 (1989); Oh-S-Y, et al., *Metallurgical Transactions A,* 20A:533–541 (1989); Mortensen, A. et al., *Metallurgical Transactions A,* 20A:2535–2547 (1989); Mortensen, A. et al. *Metallurgical Transactions A,* 20A:2535–2557 (1989); Cornie, J. A. et al., "Pressure Infiltration Processing of P-55 (Graphite) Fiber Reinforced Aluminum Alloys," in *Ceramic Transactions, Advanced Composite Materials*, M. D. Sacks, ed., 19:851–875 (The American Ceramic Society, Inc., Westerville, Ohio, 1991); Jonas T. R. et al., "Infiltration and Wetting of Alumina Particulate Preforms by Aluminum and Aluminum-Magnesium Alloys," *Metallurgical Transactions A,* 26A:1491–1497 (1995); Oh, S-Y., "Wetting of Ceramic Particulates with Liquid Aluminum Alloys," Ph.D. thesis for the Department of Materials Science and Engineering, Massachusetts Institute of Technology, September, 1987; and Masur, L., "Infiltration of Fibrous Preforms by a Pure Metal," Ph.D. thesis for the Department of Materials Science and Engineering, Massachusetts Institute of Technology, February, 1988.

Typically, the pressure vessel is pressurized to about 800 to 1000 pounds per square inch. As stated above, although compressed gas often is used to apply pressure to the molten infiltrant, other means of providing the required pressure may be used such as a mechanical piston. A critical factor is achieving complete infiltration of the mold cavity and preform, if present, before initiating cooling so the finished cast part will have substantially the near net-shape of the mold with low porosity.

The flow of molten infiltrant into a mold cavity containing a preform may be described by the equation $$\frac{L}{\sqrt{t}} = \sqrt{\frac{2\Delta P_{\mu} K}{\mu(1 - V_f)}} \tag{1}$$

where the applied pressure differential, $\Delta P_a$, is equal to $\Delta P_{65} + \Delta P_{\mu} + \Delta P_{v}$. The variables of equation (1) are: $\Delta P_{\mu}$, the pressure differential required to exceed viscous drag; L, the distance molten infiltrant has moved; K, the permeability of the preform; $\mu$, the viscosity of the infiltrant; $V_f$, the volume fraction of the reinforcement; and t, time. The other variables in the applied pressure differential equation are: $\Delta P_\gamma$, the pressure differential required to overcome the lack of wettability of a reinforcement, i.e., overcome capillary forces; and $\Delta P_v$, the back pressure differential inside the unreinforced region or void that is forming.

Figure 7:
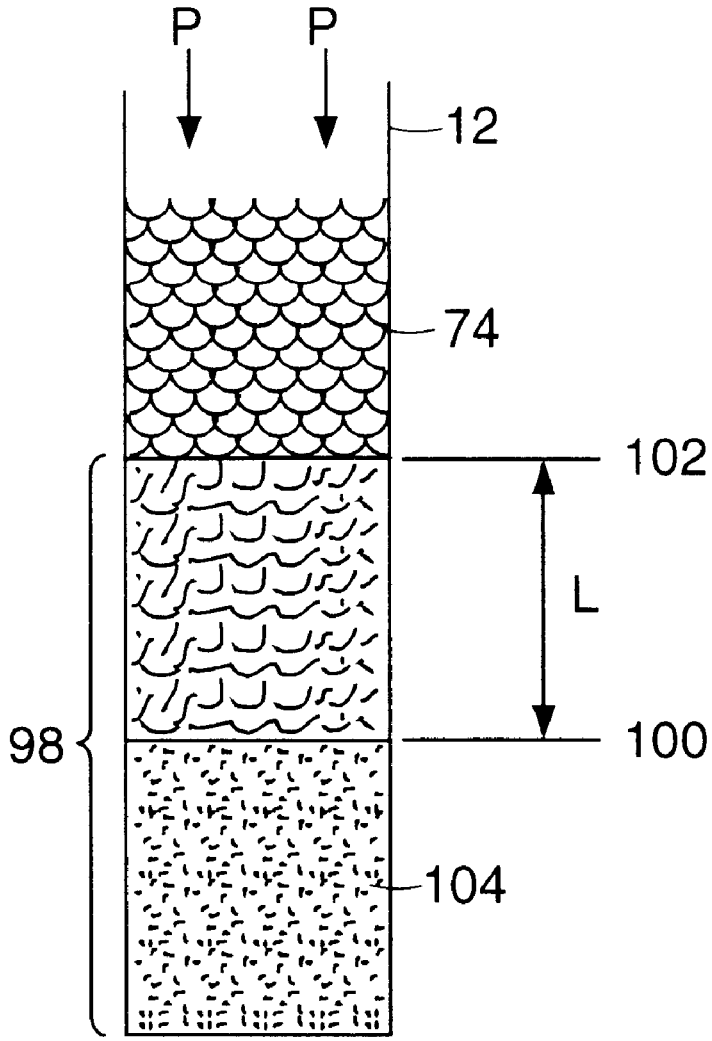
FIG. 7 is a theoretical model of a side cross-sectional view of molten infiltrant flowing into a mold vessel containing an evacuated preform.

FIG. 7 is a theoretical model of a side cross-sectional view of molten infiltrant 74 flowing into a mold vessel 12 containing an evacuated preform 98. FIG. 7 depicts partial infiltration of the evacuated preform 98 where the infiltration front 100 has moved a distance L from the top of the preform 102. Uninfiltrated evacuated preform is represented by the numeral 104. Pressure on the molten infiltrant 74 is applied in the direction of the arrows from the reference letters "P".

As shown in FIG. 7 and described by the above equation, as the evacuated preform 98 is filled, L is the distance molten infiltrant 74 has moved. During infiltration, the value of L increases to a maximum distance equal to the length of the evacuated preform 98.

After complete infiltration and during the cooling stage when molten infiltrant 74 from a hot top is provided simultaneously during directional cooling, L represents the distance from the top of the preform 102 to the solidification front, i.e., the solidified infiltrant front. During solidification, the value of L decreases as molten infiltrant directionally solidifies towards the top of the preform 102. In the case where additional molten infiltrant is provided simultaneously during directional cooling, $\Delta P_\gamma$ and $\Delta P_v$ are zero. Thus, the applied pressure, $\Delta P_a$, is equal to the viscous drag pressure, $\Delta P_\mu$.

Accordingly, as stated above, during directionally cooling, the solidification front approaches the gate to the mold cavity. Consequently, the distance, L, decreases as molten infiltrant from a hot top continuously flows to supply the shrinking infiltrant as it cools. Since L is proportional to the pressure differential required to charge molten infiltrant into the mold cavity, the required applied pressure also decreases. Thus, it is possible for the mold vessel to be removed from the pressure vessel prior to complete solidification of the cast part as long as a pressure differential of atmospheric pressure is sufficient to deliver additional molten infiltrant to the advancing solidification front. By exploiting this technique, overall throughput for cast parts may be increased further since the time for infiltration in the pressure vessel will be reduced.

Manipulation of other variables of equation (1) may produce similar results. In particular, if a lower volume fraction preform is used, the preform will have a higher permeability. Similar to the above discussion, the time required for infiltration of the mold vessel in the pressure vessel may be reduced. Moreover, manipulation of both the feeding distance and the permeability of the preform may reduce the time a pressure vessel is needed for infiltration even further. See, e.g., Jonas T. R. et al., "Infiltration And Wetting Of Alumina Particulate Preforms By Aluminum And Aluminum-Magnesium Alloys," Metallurgical Transactions A, 26A:1491–1497 (1995); Oh, S-Y., "Wetting of Ceramic Particulates with Liquid Aluminum Alloys," Ph.D. thesis for the Department of Materials Science and Engineering, Massachusetts Institute of Technology, September, 1987; and Masur, L., "Infiltration of Fibrous Preforms by a Pure Metal," Ph.D. thesis for the Department of Materials Science and Engineering, Massachusetts Institute of Technology, February, 1988.

In practice, the pressure required for complete infiltration for the specific infiltrant mold and preform will be known from theoretical calculations and/or experimentation. Once a threshold pressure is exceeded, complete infiltration should have occurred and cooling can be initiated. Upon complete infiltration of the mold cavities and preform, if present, the insulation layer 28 of the mold vessel also becomes infiltrated with molten infiltrant (see FIG. 6). Although the infiltrant present in the insulation layer 28 does not form part of the finished product, the infiltrant in this region provides increased surface area in contact with the mold vessel 12 and mold 14 to increase the rate of heat transfer from the mold 14 and molten infiltrant 74, i.e., increase the rate of solidification.

As stated above, by insulating the top and side walls of a mold vessel 12, a "hot top" or reserve of molten infiltrant 106 is maintained in communication with the solidification front which allows additional metal to be fed into the mold cavity 18 if sufficient pressure is maintained during the cooling step. Since a steep temperature gradient may be established, directional and predictable solidification is realized.

Continuously supplying molten infiltrant from a hot top 106 to the mold cavity 18 reduces the amount of shrinkage of the infiltrant due to volume change associated with solidification. For example, the solidification of aluminum involves approximately a 6% by volume shrinkage. If additional molten aluminum is not provided into the mold cavity, the finished cast product will have high porosity. Thus, for high density near net-shape cast parts, adequate pressure should be maintained until the solidification front passes through the mold cavity and into the gate.

Solidification Stage

Various techniques for solidifying molten infiltrant in a mold cavity exist. Typically, a directional solidification technique is used so the finished product will have a particular predictable internal structure. That is, a particular microstructure of the infiltrant or reinforced casting may be obtained. In addition, if pressure is maintained for some time during the cooling stage, the porosity of the finished product may be reduced.

Often a cooling platform, i.e. chill plate, is contacted with the bottom of the mold vessel to transfer the heat away from the bottom of the mold vessel to solidify the molten infiltrant. In this case, the bottom of the mold vessel is an example of a heat transfer surface. A chill plate or solid chill may be made of a material with a high melting point such as steel or copper which remains solid while conducting heat away from the mold vessel. The chill plate optionally may have active cooling means to increase the heat transfer. A non-limiting example of active cooling means is piping which has a cooling liquid, typically water, flowing therethrough. The cooling liquid often is recirculated through a chiller or is used from a general supply source and discarded after use, e.g., piping into a drain.

Pressure infiltration of a mold cavity and preform, if present, typically requires only seconds to occur. Solidification of the molten infiltrant typically requires more time. Accordingly, in a preferred embodiment, the length of time for solidification limits the maximum production rate for a given pressure vessel. By a method of the invention, an increased heat transfer technique is provided which uses a low melting temperature material as a chill to increase heat transfer between the mold vessel and the low melting temperature material. The increased rate of heat removal results in shorter solidification times thereby increasing the throughput from a pressure vessel, and ultimately, the overall throughput for the pressure infiltration casting process. Moreover, the increased rate of heat removal reduces the thermal exposure a preform experiences and reduces the amount of time for deleterious reactions between the preform and infiltrant so preforms made of heat sensitive materials may be used with methods of the invention.

In practicing methods of the invention, the low melting temperature material will have a liquid heat transfer zone which is exposed to a heat transfer surface. The heat transfer surface is in thermal communication with the mold vessel, mold cavity and molten infiltrant. In preferred embodiments, the heat transfer surface is defined by the mold vessel bottom and/or mold vessel walls. However, the heat transfer surface may be any surface which is in thermal communication with the molten infiltrant. In this way, the heat transfer coefficient is increased because a solid/liquid interface, i.e., the heat transfer surface/liquid heat transfer zone interface, has better thermal contact and a higher rate of heat transfer than a solid/solid or solid/gas interface.

The heat transfer, q, across an interface can be expressed as $$q=h(T_2-T_1) \quad (2)$$

where h is the heat transfer coefficient and T is the temperature at interface 1 and interface 2. The heat transfer coefficient, h, generally is a low value when applied to the interface between a gas and a solid or two solids. Chills ordinarily are made of high melting point materials which remain solid during the cooling process. A solid chill will have incomplete contact with a surface of a mold vessel. The mold vessel surface and solid chill surface will have asperities, i.e., a roughness at a certain dimensional level, so contact between the two surfaces will be uneven and incomplete. Accordingly, air gaps are present between the mold vessel and the chill, reducing the efficiency of heat transfer.

On the other hand, the heat transfer coefficient is higher between a solid immersed in a liquid because the contact between solid and the liquid is nearly complete, i.e., substantially congruent at the solid/liquid interface. Therefore, providing a liquid heat transfer zone in intimate contact with a mold vessel will accelerate the rate of solidification of the molten infiltrant and increase the throughput of finished cast products.

A low melting temperature material generally refers to a material that has a melting point below the solidification temperature of the infiltrant to be cast. A low temperature melting material may include any solid composition of matter and any liquid composition of matter that is capable of heat transfer in the operating temperature range of the pressure infiltration process as long as the material does not decompose, react or vaporize over the range of temperatures. Preferred low melting temperature materials will have a melting point below the melting point or liquidus temperature, and more preferably below the solidification temperature, of the infiltrant. A preferred low melting temperature material also has a high vapor pressure to prevent its vaporization and subsequent contamination of the cast product. In addition, the low melting temperature material should be relatively non-toxic and resistant to oxidation which may form an oxide layer on the low melting temperature material thereby impeding efficient heat transfer.

The low melting temperature material may be a composition of matter that melts locally as it contacts a heated mold vessel or the low melting temperature material may be partially or completely in a liquid state or molten prior to contact with the mold vessel. Preferably, the low melting temperature material has a melting point which permits a liquid heat transfer zone to be created upon contact with a heated mold vessel.

However, with certain compositions and processes, it may be desirable to apply heat to a low melting temperature material to provide a liquid heat transfer zone prior to initiating cooling of the molten infiltrant. For example, a heat source such as coils with heated oil passing therethrough may be used to melt the low temperature material prior to infiltration. Upon initiating cooling, the heat source may be removed to facilitate solidification. Besides removing the heat source, a cooling source may be used to facilitate further the solidification process. That is, in the above example, the heated oil may be replaced with a cooling liquid.

Examples of low melting temperature materials include, but are not limited to, metals, metallic alloys, salts or organic compounds. Table 1 shows non-limiting examples of low melting temperature materials which are organic compounds, salts or eutectic mixtures where $T_m$ is the melting point of the material. Table 2 shows non-limiting examples of solder compositions which are useful as low melting temperature materials.

In preferred embodiments, the low melting temperature material may be, among other materials, aluminum, antimony, bismuth, cadmium, gallium, indium, tin, lead, zinc, solder, woods metal, and various combinations thereof. For example, a eutectic alloy such as Aluminum-5% Zinc which has a melting point of 382° C. could be used. Other examples include mercury and arsenic, however their toxicity tends to prevent their practical use. Of course the selection of the appropriate low melting temperature material will depend on the infiltrant to be cast since the melting point of the infiltrant will dictate the upper melting point of the chill.

TABLE 1

| Low Melting Temperature Material | $T_m$ (° C.) |
|---|---|
| S | 112 |
| $NaNO_3/KNO_3$ | 250 |
| $NaClO_3$ | 255 |
| $NaNO_3$ | 310 |
| $BaCl_2/NaCl_2$ | 335 |
| $KNO_3$ | 388 |

TABLE 2

| Bi (%) | Pb (%) | Sn (%) | Cd (%) | In (%) | Sb (%) | $T_m$ (° C.) |
|---|---|---|---|---|---|---|
| 44.7 | 22.6 | 8.3 | 5.3 | 19.1 | | 47 |
| 49 | 18 | 12 | | 21 | | 58 |
| 48 | 28.5 | 14.5 | | | 9 | 102 |
| 60 | | 40 | | | | 138 |

Figure 8A:
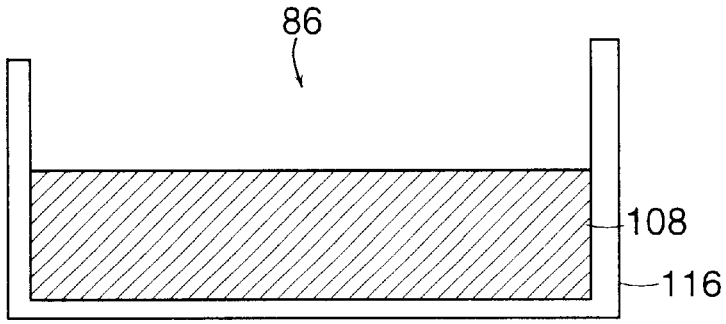
FIGS. 8A–8C are schematics of side cross-sectional views of examples of embodiments of the invention for increased heat transfer during cooling which use a low melting temperature material.
Figure 8B:
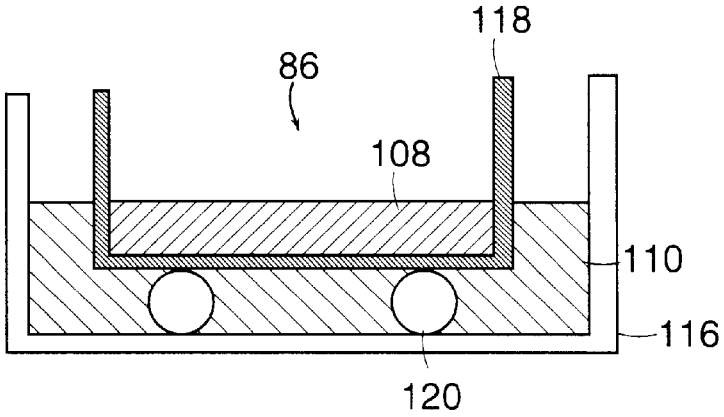
Figure 8C:
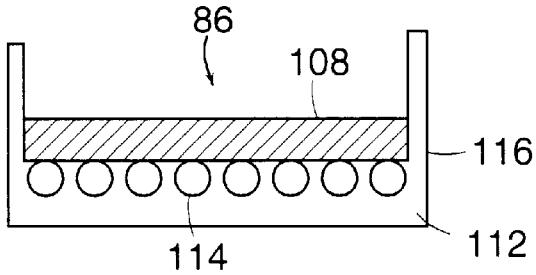

FIGS. 8A–8C depict various side cross-sectional views of non-limiting embodiments of chills 86 of the invention for increased heat transfer cooling. FIG. 8A is a large reservoir of a low melting temperature material 108 in a chill vessel 116. FIG. 6 depicts a "one material" chill in a pressure vessel 84. Note that the heat transfer surface 122 includes the mold vessel bottom 124 and part of the mold vessel walls 15. As shown, the chill vessel 116 usually has additional internal void volume, e.g., elevated sides. The additional internal void volume prevents the low melting temperature material from spilling over the sides of the container during the solidification stage when a mold vessel displaces the low melting temperature material in the container.

It should be understood that the low temperature melting material 108 may be a solid or a liquid prior to the solidification stage. A heat source may be used to create a liquid heat transfer zone while the chill 86 is in the pressure vessel.

Upon initiating cooling, the heat source is removed. In practice, ideally the low melting temperature material close to the mold vessel liquefies while the low melting temperature material at a distance from the mold vessel remains solid.

FIG. 8B is a preferred embodiment of the invention for increased heat transfer cooling using a "two-material" chill. In this embodiment, a small reservoir of a low melting temperature material 108 contained in an inner chill vessel 118 is set within a larger reservoir of a higher melting temperature material 110 which preferably remains solid during solidification of the molten infiltrant. In a preferred embodiment, the inner chill vessel 118 is conical shaped to provide increased internal void volume to accommodate the displacement of the molten low melting temperature material 108 and provide additional stability for the inner chill vessel 118.

Shown also in FIG. 8B is a stopper 120 or stoppers of an appropriate material which are placed on the inside bottom of the chill vessel 116 to prevent the bottom of the inner chill vessel 118 from completely submerging in the molten high melting temperature material 110 when forming the chill or during solidification. The stopper 120 typically will contact little surface area of the vessels so as not to interfere with the heat transfer process. As with all chills of the invention, the depth of the low melting temperature material in a chill vessel and the distance that a mold vessel must move to make appropriate contact with the low melting temperature material are parameters which must be determined for the particular apparatus used.

The high melting temperature material 110 usually is a highly conductive material for transfer of latent heat of solidification from the low melting temperature material 108. The high melting temperature material 110 may be associated with active cooling means to assist the heat transfer process. The low melting temperature material 108 does not necessarily need to be set in the larger reservoir of higher melting temperature material 110. However, the low melting temperature material 108 should be positioned so that it can contact both the mold vessel 112 and the larger reservoir of higher melting temperature material 110 for efficient heat transfer. In addition, this embodiment is not limited only to two materials for forming the chill 86, as multiple layers of the appropriate materials having the proper heat transfer coefficients and/or chill vessels are envisioned to provide an increase rate of heat transfer away from the mold vessel.

The preferred embodiment shown in FIG. 8B provides the necessary low melting temperature material for achieving complete contact with the mold vessel and allows a low cost material to be used for the bulk of the chill. These chills preferably are designed so that the latent heat of fusion of the low melting temperature material and/or the high melting temperature material is about equal to the latent heat of solidification of the molten infiltrant. For example, the latent heat of fusion of a tin plus bismuth-tin alloy mass is about one sixth the heat of solidification of aluminum. Thus, to remove the latent heat to solidify molten aluminum, the mass of the tin and bismuth-tin alloy should be six times the mass of the infiltrating aluminum. That is, this proportion of lower and higher melting temperature materials provides sufficient exchange of latent heat of fusion of the molten infiltrant for the latent heat of solidification of the higher melting temperature material. Accordingly, no additional means of cooling, e.g., active cooling means such as flow through cooling coils, are required.

In practice, a larger of quantity of molten infiltrant can be solidified rapidly since heat transfer also occurs through the walls of the pressure vessel because of physical contact between the chill vessel and the pressure vessel. In addition, heat is transferred to the interior of the pressure vessel chamber by conduction and convection of the pressurizing gas. Accordingly, in preferred embodiments of the invention, the ratio of the amount of the low melting temperature material and/or the high melting temperature material to the amount of infiltrant is at least 90%, preferably at least 80% and more preferably at least 70%. In other words, the amount of low melting temperature material and/or high melting temperature material used is 90% (or 80% or 70%) the amount of molten infiltrant to be solidified. Moreover, with the appropriate apparatus, conditions and active cooling, this ratio can be reduced further.

FIG. 8C is a chill 86 consisting of a low melting temperature material 108 having active means for heat removal 112. Various techniques of active cooling are contemplated. FIG. 8C depicts one such technique which uses pipes 114 having fluid flowing therethrough to facilitate increased heat removal.

Figure 9:
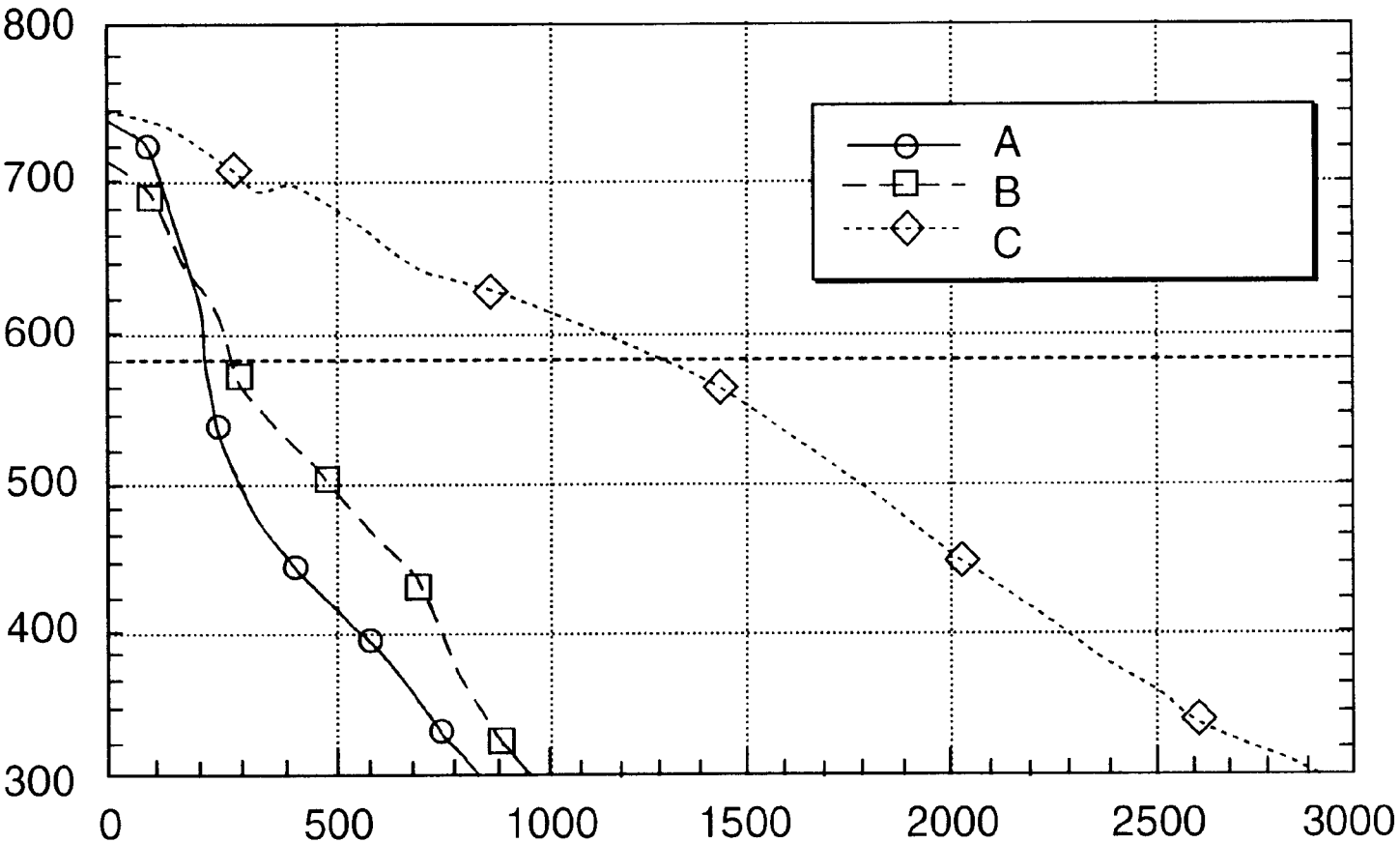
FIG. 9 is a graph depicting temperature (in ° C. at a point about 4.5 inches above the bottom of the mold vessel casting) as a function of time (in seconds) for cooling an aluminum alloy (AA2214) in a mold vessel using a low melting temperature material chill (graph of A); a tin chill (graph of B); and no chill (graph of C).

In practice, the improved heat transfer method of the invention for cooling cast parts demonstrates over an 80% decrease in the solidification time compared to using a solid chill. FIG. 9 is a graph that shows the rate of cooling a mold vessel containing an aluminum alloy (AA2214; melting point about 640° C.; solidification temperature about 580° C.) in a mold cavity using: (A) a chill having a small reservoir of bismuth-tin alloy contacting a larger reservoir of tin; (B) a tin chill; and (C) a solid contact chill (e.g., steel or copper). The temperature was measured 4.5 inches above the bottom of the mold vessel. As shown in FIG. 9, the aluminum alloy solidified using a solid contact chill in about 22 minutes, using the tin chill in about 5 minutes and using a low melting temperature material in about 4 minutes. Thus, the time for solidification is significantly reduced using a low melting temperature material which allows increased throughput for the cooling step. Moreover, by increasing the rate of solidification, throughput for the overall pressure infiltration casting process is increased.

The following example is provided for illustration and is not intended to limit the invention in any way.

A two material chill was prepared as follows. An outer open top steel container (560 mm diameter by 350 mm height) was loaded with 140 kg of tin (melting point 232° C.). An inner open top steel container (460 mm diameter by 380 mm height) was loaded with 100 kg of a bismuth-tin alloy (60% Bi/40% Sn; melting point 138° C.). The tin in the outer container was melted and the inner container placed into the molten tin creating a liquid-solid contact interface to facilitate heat transfer. After the molten tin was solidified, the double container assembly was loaded into the bottom of an autoclave, i.e., a pressure vessel. Based on latent heats of fusion and solidification, this two material chill system is capable of rapidly solidifying at least about 40 kg of aluminum infiltrant.

After molten infiltrant was charged into the interior of a mold vessel using a fill tube, the mold vessel/molten infiltrant assembly with evacuated mold cavities was transferred to an autoclave. The mold vessel/molten infiltrant assembly was suspended above the aforementioned two material chill. The autoclave was sealed and nitrogen gas charged into the autoclave until a pressure of about 55 atmospheres was attained. After allowing approximately 1 minute for complete infiltration, the mold vessel/molten infiltrant assembly was lowered with a hydraulic cylinder to contact the low melting temperature material chill in the inner container containing the bismuth-tin alloy. Since the bismuth-tin alloy has a melting point of about 138° C., the alloy readily melted and the mold vessel settled into the inner container providing a liquid-solid interface for efficient heat transfer.

A thermocouple located in a tubular restraining device at the top of the mold vessel monitored the temperature of the casting process. After infiltration and when the molten infiltrant had cooled to a temperature of about 200° C., the mold vessel was retracted from chill to prevent the mold vessel from being solidified to the chill. The pressure in the autoclave was released and the mold vessel was removed from the autoclave and allowed to cool to ambient temperature outside of the autoclave. The autoclave then was available for the next mold vessel/molten infiltrant assembly.

The invention may be embodied in other specific forms.

What is claimed is:

1. A method of pressure infiltration casting comprising the steps of:

applying pressure to a molten infiltrant in a mold cavity, wherein a mold defines the mold cavity; and exposing a heat transfer surface, in thermal communication with the molten infiltrant in the mold cavity, to a liquid heat transfer zone comprising a low melting temperature material to cool the molten infiltrant.

2. The method of claim 1 wherein the step of applying pressure to the molten infiltrant is continuous during cooling of the molten infiltrant.

3. The method of claim 1 further comprising the step of providing a high melting temperature material in thermal communication with the low melting temperature material, wherein the high melting temperature material has a melting point greater than the low melting temperature material.

4. The method of claim 3 wherein the ratio of the amount of the low melting temperature material and the high melting temperature material to the amount of the molten infiltrant is at least 75% of the ratio of the latent heat of fusion of the low melting temperature material and the high melting temperature material to the latent heat of solidification of the molten infiltrant.

5. The method of claim 3 wherein the high melting temperature material remains solid during cooling of the molten infiltrant.

6. The method of claim 1 wherein the heat transfer zone forms after exposing the heat transfer surface to the low melting temperature material.

7. The method of claim 1 wherein the heat transfer surface comprises a mold vessel surface.

8. The method of claim 1 wherein the mold cavity contains a preform.

9. The method of claim 1 wherein the low melting temperature material comprises a metal or a metal alloy.

10. The method of claim 9 wherein the metal or metal alloy is selected from the group consisting of antimony, bismuth, cadmium, gallium, indium, lead, tin, solder, woods metal, and mixtures thereof.

11. The method of claim 1 further comprising the step of providing active cooling to assist cooling the molten infiltrant.

12. A method of pressure infiltration casting comprising the steps of:

(a) applying pressure to a molten infiltrant in a mold cavity, wherein a mold defines the mold cavity and the mold cavity contains a preform; and (b) exposing a heat transfer surface, in thermal communication with the molten infiltrant in the mold cavity, to a liquid heat transfer zone comprising a low melting temperature material to cool the molten infiltrant.

13. The method of claim 12 wherein pressure is applied continuously during cooling of the molten infiltrant.

14. The method of claim 12 further comprising the step of providing a high melting temperature material in thermal communication with the low melting temperature material, wherein the high melting temperature material has a melting point greater than the low melting temperature material.

15. The method of claim 12 wherein the liquid heat transfer zone forms after exposing the heat transfer surface to the low melting temperature material.

16. The method of claim 12 further comprising the step of providing active cooling to assist cooling the molten infiltrant.

17. A method of pressure infiltration casting comprising the steps of:

(a) exposing a heat transfer surface comprising a mold vessel surface, in thermal communication with a molten infiltrant and a preform in a mold cavity, to a liquid heat transfer zone comprising a low melting temperature material to cool the molten infiltrant, wherein a mold defines the mold cavity and the low melting temperature material comprises a metal or metal alloy; and (b) applying pressure continuously to the molten infiltrant during step (a).

18. The method of claim 17 further comprising the step of providing a high melting temperature material in thermal communication with the low melting temperature material, wherein the high melting temperature material has a melting point greater than the low melting temperature material.

19. The method of claim 17 wherein the liquid heat transfer zone forms after exposing the heat transfer surface to the low melting temperature material.

20. The method of claim 17 further comprising the step of providing active cooling to assist cooling the molten infiltrant.

* * * * *